US005781203A

United States Patent [19]

Uriu et al.

[11] Patent Number: 5,781,203

[45] Date of Patent: Jul. 14, 1998

[54] INK EJECTING DEVICE FOR USE IN AN INK JET PRINTING APPARATUS

[75] Inventors: Yoshiko Uriu; Eiichi Tone, both of Osaka, Japan

[73] Assignee: Mita Industrial Co., Ltd., Osaka-fu, Japan

[21] Appl. No.: 581,638

[22] Filed: Dec. 28, 1995

[30] Foreign Application Priority Data

Jan. 13, 1995 [JP] Japan ..... 7-4073
Mar. 6, 1995 [JP] Japan ..... 7-45792

[51] Int. Cl.[6] ..... B41J 29/38; B41J 2/045

[52] U.S. Cl. ..... 347/9; 347/68; 347/10

[58] Field of Search ..... 347/9, 68, 20, 347/23, 11, 48, 10, 54

[56] References Cited

U.S. PATENT DOCUMENTS 5,563,634 10/1996 Fujii et al. ..... 347/9

*Primary Examiner*—N. Le
*Assistant Examiner*—Thinh Nguyen
*Attorney, Agent, or Firm*—Jordan and Hamburg

[57] ABSTRACT

An ink ejecting device for use in an ink jet printing apparatus, includes: a number of ejecting elements arranged in a matrix having a first number of columns and a second number of rows, each ejecting element having: an ink chamber whose volume is changeable, an ejection nozzle communicating with the ink chamber, and an ink supply hole communicating with the ink chamber, and an piezoelectric conversion element, a drive portion for driving piezoelectric conversion elements of each column in a manner for expanding the ink chamber to allow ink to flow into the ink chamber and contracting the ink chamber to eject ink from the ink chamber through the ejection nozzle.

19 Claims, 20 Drawing Sheets

INK EJECTING DEVICE FOR USE IN AN INK JET PRINTING APPARATUS

BACKGROUND OF THE INVENTION

This invention relates to an ink ejecting device, more particularly, to an ink ejecting device for use in an ink jet printing apparatus, such as facsimile machine, copying machine, printer, computer output device, and the like.

Conventionally, there is known an ink jet printing apparatus provided with a printing head incorporating an ink ejecting device. The ink ejecting device has a number of ejecting elements which each are formed with an ink chamber and an ejection nozzle. Further, each ejecting element is provided with a piezoelectric conversion element. Ink is ejected out through the ejection nozzle in accordance with a deformation of the piezoelectric conversion element, i.e., by reducing the volume of the ink chamber of the ejecting element.

The piezoelectric conversion element has a characteristic of capacitance in an electric circuit. Accordingly, an impulse current spontaneously flows in the piezoelectric conversion element when a drive signal is sent to the piezoelectric conversion element to reduce the volume of the ink chamber. Accordingly, when a number of piezoelectric conversion elements receive drive signals at the same time, impulse currents simultaneously occur, resulting in an excessive flow of electric current. Consequently, the power source is subject to a great fluctuation. To eliminate this problem, it is necessary to provide a large power source. This requires a large space to accommodate the power source and also an increased production cost.

There has been proposed an ink ejecting device in which drive signals are sent one after another to piezoelectric conversion elements at a predetermined interval. However, this driving method takes a long time to drive all the piezoelectric conversion elements. In other words, the period of driving each ejecting element becomes longer, and the printing speed is thus lowered. For example, in a case that a printing head has 2000 ejecting elements and the driving period for each piezoelectric conversion element is 50 μsec., the total driving period for the printing head becomes 0.1 sec. (=2000×50 μsec.).

To increase the printing speed or reduce the driving period of the printing head, conventionally, a number of ejecting elements are divided into a smaller number of groups and drive signals are sent to ejecting elements from one group to another group at a predetermined interval. For example, the driving period of the printing head having 2000 ejecting elements whose respective piezoelectric conversion elements are driven at a driving period of 50 μsec. can be reduced to 0.02 sec., i.e., five times as high a speed as in the aforementioned method by dividing the number of ejecting elements into four groups and driving their respective piezoelectric conversion elements from one group to another group at an interval of $50\times10^{-6}$ sec.

However, in this driving method, 500 piezoelectric conversion elements are simultaneously driven at maximum. In other words, 500 impulse currents occur at the same time, which makes it difficult to suppress the excessive current flow.

Also, it has been proposed to arrange a number of ejecting elements in the form of a matrix, and divide the number of ejecting elements into a plurality of groups, and then drive the number of ejecting elements by group to increase the ink ejection speed with respect to a fixed area. Further, there have been disclosed several drive devices for driving such matrix-arranged ejecting elements. However, in these drive devices, an ejection switch is provided for each ejecting element. This arrangement inevitably requires a large number of switches, thus making the circuit construction and the switching control more complicated.

Japanese Unexamined Patent Publication No. 4-77260 discloses a drive device for matrix-arranged ejecting elements in which a transistor is provided for each row and each column. The row transistors and the column transistors are controllably turned on and off to drive ejecting elements by group. However, this drive device adopts a so-called "forward ejection" driving method in which ink ejection is accomplished by applying no bias voltage in the usual state and applying an activation voltage to a piezoelectric conversion element when ejecting ink. The construction of this prior art device makes it impossible to adopt a so-called "after-receding ejection" driving method in which ink ejection is accomplished by applying a bias voltage in the usual state, and temporarily decreasing the voltage to a specified low voltage level, and thereafter rapidly increasing the voltage after the low voltage when ejecting ink. The "after-receding ejection" driving method is known to be superior in the aspect of ejection performance and ejection speed to the "forward ejection" driving manner.

Also, in the drive device of this prior art document, each piezoelectric conversion element is grounded by way of the transistor. This complicates circuit construction, thus making the production of ink ejecting devices difficult.

SUMMARY OF THE INVENTION

It is an object of the present invention to provide an ink ejecting device which overcomes the problems residing in the prior art.

It is another object of the present invention to provide an ink ejecting device which is simpler in construction of electric circuits and is produced more easily.

It is another object of the present invention to provide an ink ejecting device which ensures a higher ink ejection speed while preventing undesirable simultaneous excessive current flow.

The present invention is directed to an ink ejecting device for use in an ink jet printing apparatus, comprising: a number of ejecting elements, each ejecting element having: an ink chamber whose volume is changeable, an ejection nozzle communicating with the ink chamber, and an ink supply hole communicating with the ink chamber, and an piezoelectric conversion element, a drive portion for driving piezoelectric conversion elements each column in a manner of expanding the ink chamber to allow ink to flow into the ink chamber and contracting the ink chamber to eject ink from the ink chamber through the ejection nozzle.

The drive portion may be constructed by: a drive voltage supplying portion for supplying drive voltage to piezoelectric conversion elements; an image signal output portion communicable with an image signal generator for outputting an image signal to piezoelectric conversion elements; and a controller for controlling the drive voltage supplying portion and the image signal output portion to produce an activation voltage in piezoelectric conversion elements for each column.

It may be preferable that the piezoelectric conversion element is provided with two opposite electrodes, and one of the two opposite electrodes is connected to the ground.

It may be appreciated that the controller is constructed by: a voltage switch provided between the drive voltage supplying portion and the not-grounded electrode of the piezoelectric conversion elements in each column for switching on and off electric connection between the drive voltage supplying portion and the not-grounded electrode of the piezoelectric conversion elements in the column, an image signal switch provided between the ground and the not-grounded electrode of the piezoelectric conversion elements in each row for switching on and off electric connection between the ground and the not-grounded electrode of the piezoelectric conversion elements in the row, the image signal switch being turned on when receiving an image signal, and a timing controlling portion for sending a timing signal to the voltage switches one column after another at a specified interval to turn off one voltage switch to suspend the supply of drive voltage to the not-grounded electrode of the piezoelectric conversion elements in the column for a first duration and sending a timing signal to the image signal output portion to output an image signal to the image signal switches in synchronism with the turning off of the one voltage switch, whereby a combination of the turning off of the voltage switch and the turning on of the image signal switch causing the expansion of the ink chamber, and a combination of the turning on of the voltage switch and the turning off of the image signal switch causing the contraction of the ink chamber.

The drive voltage supplying portion may be constructed by: a common supplier for outputting a drive voltage to the not-grounded electrode of all the piezoelectric conversion elements, and an individual supplier for outputting a drive voltage to the not-grounded electrode of the piezoelectric conversion elements in each column. The controller may be constructed by: a common voltage switch provided between the common supplier and the not-grounded electrode of all the piezoelectric conversion elements for switching on and off electric connection between the common supplier and the not-grounded electrode of all the piezoelectric conversion elements, an individual voltage switch provided between the individual supplier and the not-grounded electrode of the piezoelectric conversion elements in each column for switching on and off electric connection between the individual supplier and the not-grounded electrode of the piezoelectric conversion elements in each column. In this case, the timing controlling portion is made to send; a timing signal to the common voltage switch at a first interval to turn off the common voltage switch to suspend the supply of drive voltage to the not-grounded electrode of all the piezoelectric conversion elements for a first duration, a timing signal to the image signal output portion to output an image signal to the image signal switches in synchronism with the turning off of the common voltage switch, a timing signal to the individual voltage switches one column after another at a second interval to turn on one individual voltage switch to permit the supply of drive voltage to the not-grounded electrode of the piezoelectric conversion elements in the one column for a second duration in such a way that the individual voltage switch is turned on for the second duration at the same time when the common voltage switch is turned on and the image signal switch is turned off, the first duration being longer than the second duration, whereby a combination of the turning off of the common voltage switch and the turning on of the image signal switch causing the expansion of the ink chamber, and a combination of the turning on of the common voltage switch and one individual voltage switch and the turning off of the image signal switch causing the contraction of the ink chamber.

The drive voltage supplying portion may be made to supply drive voltage to the not-grounded electrode of all piezoelectric conversion elements. The controller may be constructed by: a voltage switch provided between the drive voltage supplying portion and the not-grounded electrode of all the piezoelectric conversion elements for switching on and off electric connection between the drive voltage supplying portion and the not-grounded electrode of all the piezoelectric conversion elements, an image signal switch provided between the ground and the not-grounded electrode of the piezoelectric conversion elements in each row for switching on and off electric connection between the ground and the not-grounded electrode of the piezoelectric conversion elements in the row, the image signal switch being turned on when receiving an image signal, an individual switch provided between the ground and the not-grounded electrode of the piezoelectric conversion elements in each column for switching on and off electric connection between the ground and the not-grounded electrode of the piezoelectric conversion elements in each column, a timing controlling portion for sending a timing signal to the voltage switch at a specified interval to turn off the voltage switch to suspend the supply of drive voltage to all the piezoelectric conversion elements for a specified duration, a timing signal to the image signal output portion to output an image signal to the image signal switches in synchronism with the turning off of the voltage switch, and a timing signal to the individual switches one column after another in synchronism with the turning off of the voltage switch to turn on one individual voltage switch to permit an electric discharge from the piezoelectric conversion elements in the one column to the ground, whereby a combination of the turning off of the voltage switch and the turning on of the image signal switch and the individual switch causing the expansion of the ink chamber, and a combination of the turning on of the voltage switch and the turning off of the image signal switch and the one individual switch causing the contraction of the ink chamber.

The drive voltage supplying portion may be constructed by: a bias voltage supplier for supplying a bias voltage to the not-grounded electrode of the piezoelectric conversion elements; a drive voltage signal supplier for outputting a drive voltage signal to the not-grounded electrode of the piezoelectric conversion elements in each column, the drive voltage signal having an expansion duration for expanding the ink chamber and a contraction duration for contracting the ink chamber. The controller may be constructed by: an image signal switch provided between the bias voltage supplier and the not-grounded electrode of the piezoelectric conversion elements in each row for switching on and off electric connection between the bias voltage supplier and the not-grounded electrode of the piezoelectric conversion elements in the row, the image signal switch being turned on when receiving an image signal; and a timing controlling portion for sending a timing signal to the drive voltage signal supplier at a specified interval to output a drive voltage signal to the piezoelectric conversion elements in one column, and a timing signal to the image signal output portion to output an image signal to the image signal switches in synchronism with the turning off of the voltage switch to suspend the supply of bias voltage to the piezoelectric conversion elements in each row in synchronism with the output of the drive voltage signal, whereby a combination of the output of the drive voltage signal and the turning off of the image signal switch causing the expansion of the ink chamber and the contraction of the ink chamber in accordance with the drive voltage signal.

Also, the present invention is directed to an ink ejecting device for use in an ink jet printing apparatus, comprising:

a number of ejecting elements, each ejecting element having: an ink chamber whose volume is changeable, an ejection nozzle communicating with the ink chamber, and an ink supply hole communicating with the ink chamber, and a driving element, a drive portion for driving a driving element in a manner of expanding the ink chamber to allow ink to flow into the ink chamber and contracting the ink chamber to eject ink from the ink chamber through the ejection nozzle, the drive portion driving the driving elements one after another at an interval equal to the contraction duration or an interval more than the contraction duration and less than the entire drive duration.

The drive portion may be constructed by: a drive signal output portion for outputting drive signals to driving elements, each drive signal having an expansion duration for expanding the ink chamber and a contraction duration for contracting the ink chamber; a controller for controlling the drive signal output portion to output drive signals to the driving elements one after another at an interval equal to the contraction duration or an interval more than the contraction duration and less than the entire duration of the drive signal; and an enabling portion communicable with an image signal generator for enabling each driving element to be driven by the drive signal in accordance with an image signal from the image signal generator.

The number of ejecting elements may be divided into a plurality of ejection groups. The drive signal output portion may be provided with a plurality of drive signal senders for the plurality of ejection groups, respectively, each drive signal sender for sending a drive signal to an ejecting element belonging to the group. The controller controls the drive signal senders to send a drive signal one after another at an interval equal to the contraction duration or an interval more than the contraction duration and less than the entire duration of the drive signal.

It may be appreciated that each ejection group is provided with a plurality of ink ejection units, each ink ejection unit having a specified number of ejecting elements, and each drive signal sender sends drive signals to the plurality of ink ejection units one after another in response to the controller.

The ejecting elements of each ejection group may be arranged in a matrix, ones of the rows and the columns being the ink ejection units. The driving element may be a piezoelectric conversion element.

The above and other objects, features and advantages of the present invention will become more apparent upon a reading of the following detailed description and drawings.

DETAILED DESCRIPTION OF THE INVENTION

Figure 1:
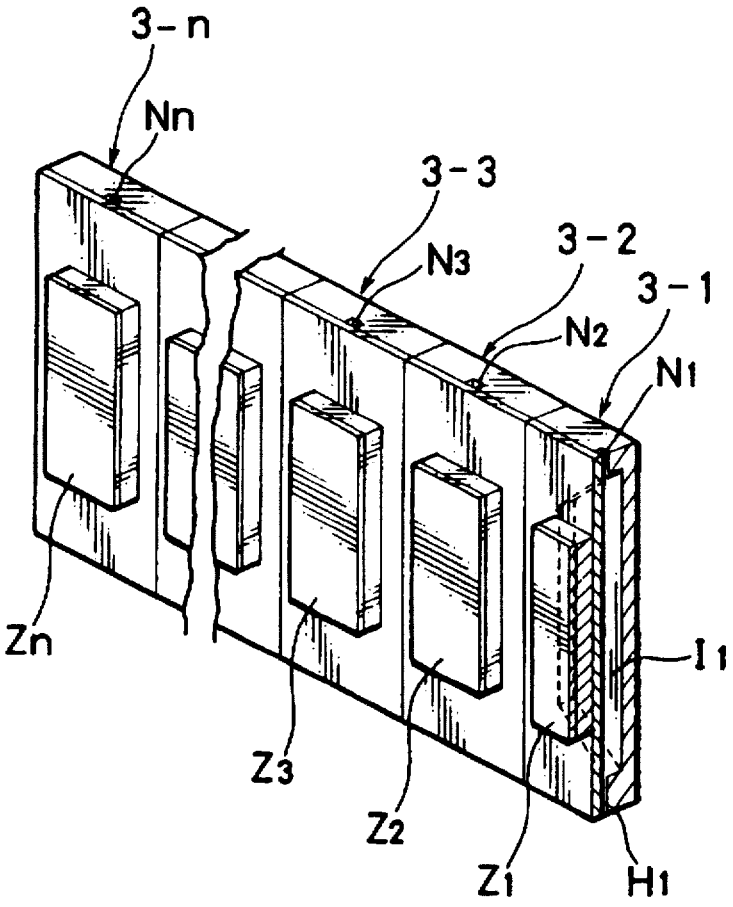
FIG. 1 is a perspective view showing an exterior of an ink ejection portion of an ink ejecting device embodying the present invention.
Figure 2:
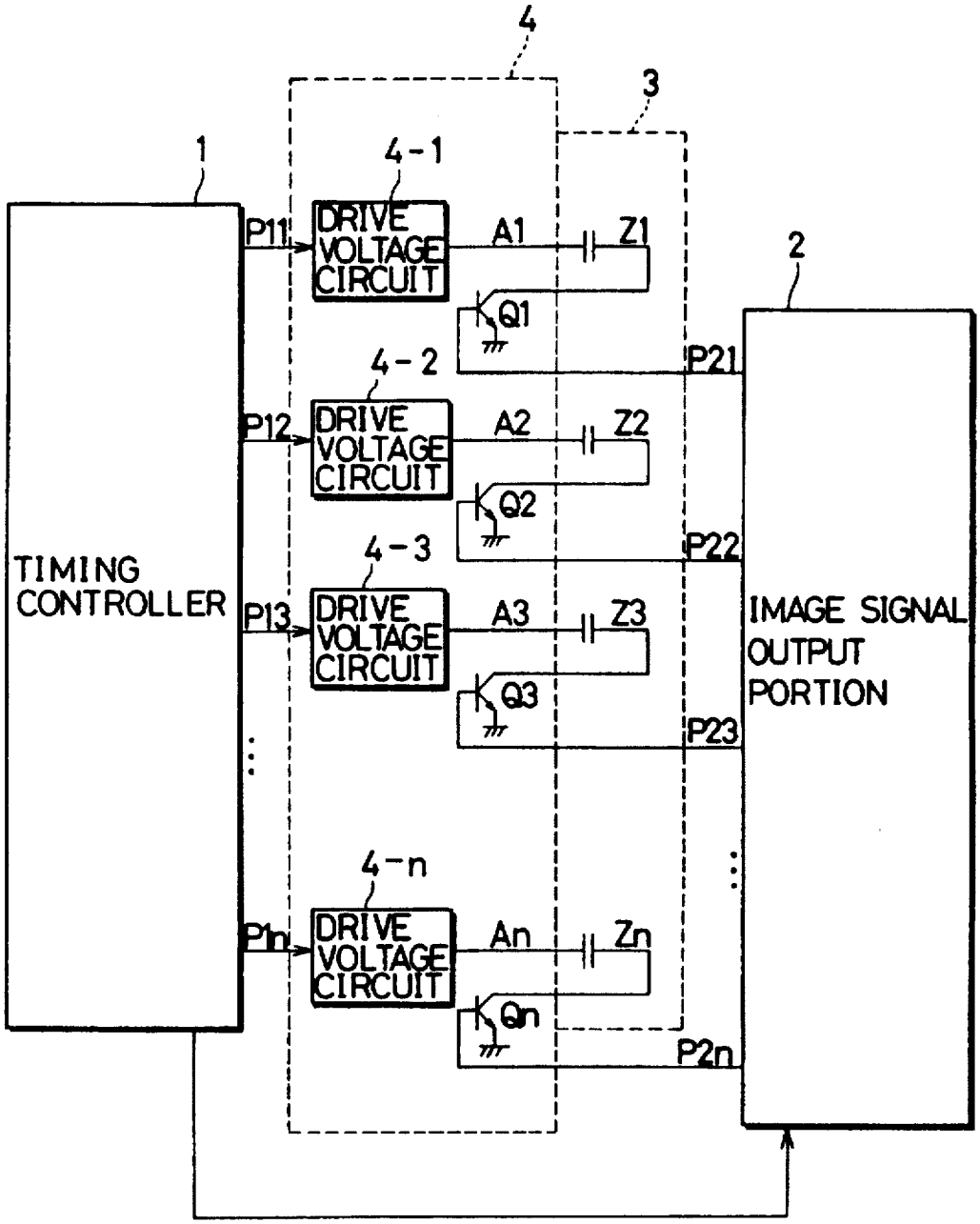
FIG. 2 is a block diagram showing an arrangement of a first ink ejecting device of the present invention.

A first ink ejecting device of the present invention is described with reference to FIGS. 1 to 3. In this embodiment, the ink ejecting device is used as a printing head of an ink jet printing apparatus. The ink ejecting device includes a timing controller 1, an ink ejection portion 3, and a driving portion 4. The ink ejection portion 3 has a number of ejecting elements. These ejecting elements are driven in accordance with an image signal from an image signal output portion 2. The driving portion 4 generates a drive signal for driving a driving element provided on each ejecting element. The image signal output portion 2 enables ejecting elements to be driven by the drive signal. The image signal output portion 2 outputs an enabling signal in accordance with an image signal.

The ink ejection portion 3 includes ejecting elements 3-1 to 3-n. The ejecting elements 3-1 to 3-n are arrayed in a line at a specified interval. The ejecting elements 3-1 to 3-n have ink chambers I1 to In for containing ink. The ejecting elements 3-1 to 3-n are formed with ejection nozzles N1 to Nn and ink supply holes H1 to Hn, respectively. Ink is supplied to the ink chambers I1 to In through the ink supply holes H1 to Hn from an unillustrated ink reservoir. At a specified position of a wall defining the ink chamber is provided a driving element Z1 (to Zn) to change the volume of the ink chamber. In this embodiment, a piezoelectric conversion element is used as the driving element. The piezoelectric conversion element changes its geometric form in response to electric charges. Application of an electric drive signal to the piezoelectric conversion element Z1 (to Zn) deforms the element to reduce the volume of the ink chamber, thereby ejecting ink from the ink chamber through the ejection nozzle.

In this embodiment, a so-called "after-receding ejection" driving method is adopted. In this driving method, a bias voltage of a specified level is constantly applied to the piezoelectric conversion element to keep the ink chamber in a pressurized state. Immediately before ink ejection, the voltage which has been applied to the piezoelectric conversion element is temporarily dropped down to a specified level to temporarily reduce the pressure in the ink chamber. Thereafter, a drive voltage signal is applied to the piezoelectric conversion element to raise the pressure in the ink chamber again, thereby ejecting ink from the ink chamber through the ejection nozzle.

The driving portion 4 includes drive voltage circuits 4-1 to 4-n, and transistors Q1 to Qn. The drive voltage circuits 4-1 to 4-n are serially connected to the transistors Q1 to Qn via the piezoelectric conversion elements Z1 to Zn, respectively. The timing controller 1 includes output ports P11 to P1n to which the drive voltage circuits 4-1 to 4-n are connected respectively. The drive voltage circuits 4-1 to 4-n output drive voltage signals each having a specified waveform as shown in FIG. 3 in accordance with timing signals output from the corresponding output ports of the timing controller 1.

The transistors Q1 to Qn have their collectors connected to the piezoelectric conversion elements Z1 to Zn, respectively; have their bases connected to the image signal output portion 2; and have their emitters connected to the ground. When the transistor is turned on, one of the positive or negative electrodes of the corresponding piezoelectric conversion element is connected to the ground.

The image signal output portion 2 outputs image signals P21 to P2n read by an unillustrated image reader to the bases of the transistors Q1 to Qn in parallel as timed with a timing signal output from the timing controller 1. The image reader includes photoelectric conversion elements, such as CCD (Charge Coupled Device), phototransistor, and an image data processing circuit. When ink is ejected, the image signal output portion 2 outputs an image signal at a high level to turn a specified transistor on. On the other hand, when ink is not ejected, the image signal output portion 2 outputs an image signal at a low level to turn a specified transistor off. These image signals P21 to P2n are output from the image signal output portion 2 in accordance with a timing signal output from the timing controller 1.

It will be appreciated that the image signal output portion 2 outputs an image signal in accordance with image data generated by an image data generator, such as, personal computer.

The timing signals are output from the output ports P11 to P1n of the timing controller 1 to the drive voltage circuits 4-1 to 4-n at an interval d in this order to control the timing at which the drive voltage signals are output from the drive voltage circuits 4-1 to 4-n to the respective piezoelectric conversion elements Z1 to Zn. The interval d is set to equal to a duration of an impulse current in each driving.

Specifically, a timing signal from the output port P11 is first output to the drive voltage circuit 4-1; a timing signal from the output port P12 is output to the drive voltage circuit 4-2 in the interval d after the outputting of the timing signal from the output port P11; a timing signal from the output port P13 is then output to the drive voltage circuit 4-3 in the interval d after the outputting of the timing signal from the output port P12; . . . ; and a timing signal from the output port P1n is output to the drive voltage circuit 4-n in the interval d after the outputting of the timing signal from the output port P1(n-1).

The timing controller 1 further controls the image signal output portion 2 to output image signals P21 to P2n to the corresponding transistors Q1 to Qn in synchronism with the output of the drive voltage signals from the drive voltage circuits 4-1 to 4-n. In other words, at the time when the image signal output portion 2 outputs the high level image signal P21 (to P2n) to turn the transistor Q1 (to Qn) on and the electrode of the piezoelectric conversion element Z1 (to Zn) is connected to the ground, the drive voltage signal is applied to the piezoelectric conversion element Z1 (to Zn) from the drive voltage circuit 4-1 (to 4-n) to drive the ejecting element 3-1 (to 3-n).

Figure 3:
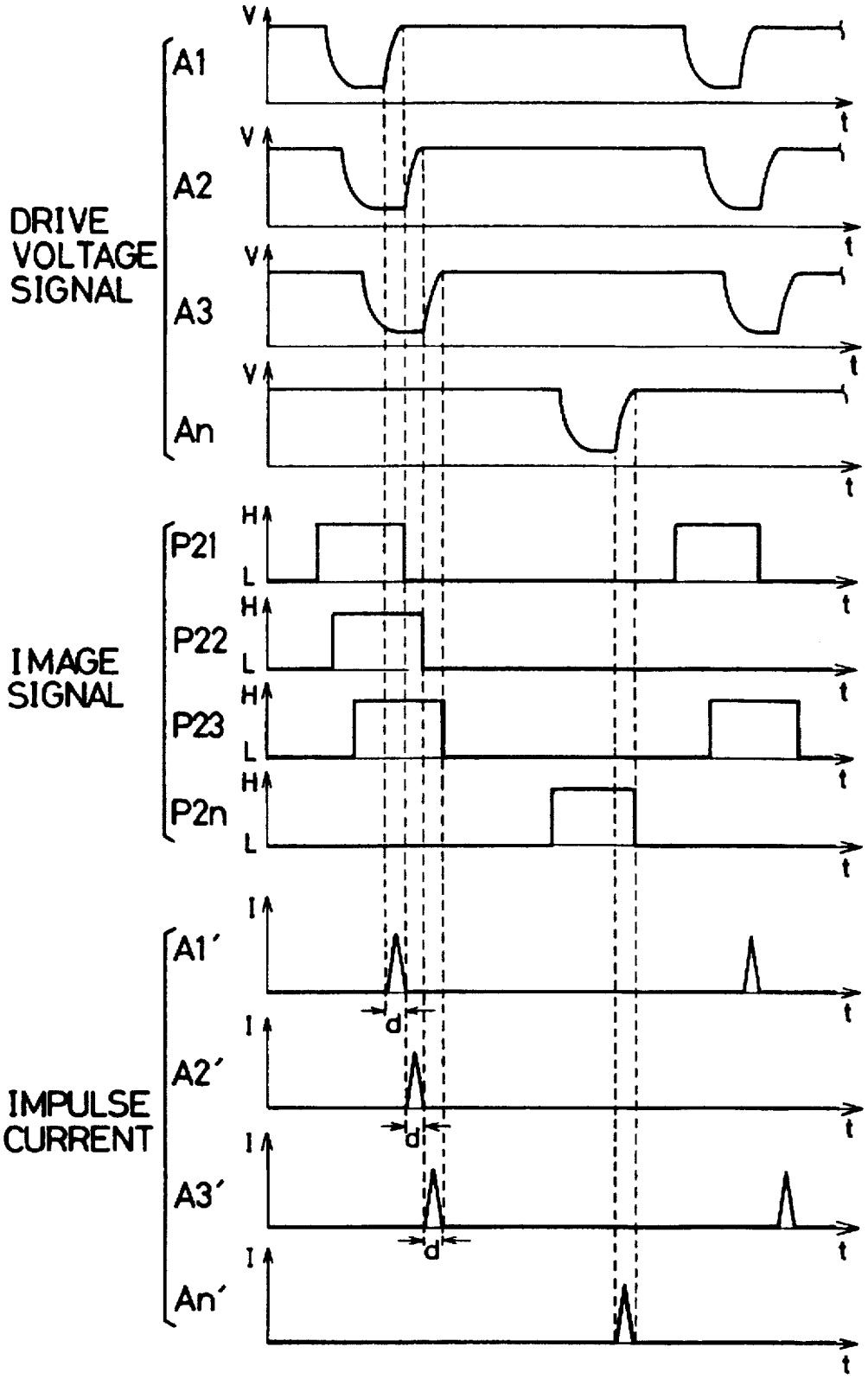
FIG. 3 is a timing chart showing a relationship between drive voltage signals from drive voltage circuits, image signals from an image signal output portion, and impulse currents flowing to piezoelectric conversion elements in the first ink ejecting device.

Referring to FIG. 3, more specifically, in synchronism with the outputting of the high level image signal P21 for black image representation to turn the transistor Q1 on and allow the electrode of the piezoelectric conversion element Z1 to connect to the ground, the drive voltage circuit 4-1 outputs the drive voltage signal A1 to the piezoelectric conversion element Z1. Upon the application of the drive voltage signal A1 to the piezoelectric conversion element Z1, the volume of the ink chamber I1 shrinks and ejects ink from the ink chamber through the ejection nozzle N1. In this time, an impulse current A1' having a duration d flows into the piezoelectric conversion element Z1.

In the time d after the application of the drive voltage signal A1 to the piezoelectric conversion element Z1, the high level image signal P22 is output for black image representation, the transistor Q2 is turned on, and the electrode of the piezoelectric conversion element Z2 is connected to the ground. As timed with the output of the high level image signal P22, the drive voltage circuit 4-2 outputs the drive voltage signal A2 to the piezoelectric conversion element Z2. In this time, similarly, an impulse current A2' having a duration d flows into the piezoelectric conversion element Z2. However, since there is the time delay d between the output of the drive voltage signal A1 to the piezoelectric conversion element Z1 and the output of the drive voltage signal A2 to the piezoelectric conversion element Z2, the impulse current A2', flowing into the piezoelectric conversion element Z2, does not occur at the same time as the impulse current A1' flowing to the piezoelectric conversion element Z1.

In the time d after the application of the drive voltage signal A2 to the piezoelectric conversion element Z2, the high level image signal P23 is output for black image representation, the transistor Q3 is turned on, and the electrode of the piezoelectric conversion element Z2 is connected to the ground. As timed with the output of the high level image signal P23, the drive voltage circuit 4-3 outputs the drive voltage signal A3 to the piezoelectric conversion element Z3. In this time, similarly, an impulse current A3' having a duration d flows into the piezoelectric conversion element Z3 and does not occur at the same time as the impulse current A2' flowing to the piezoelectric conversion element Z2 because of the time delay d.

Similar operations are repeated at successive intervals until the piezoelectric conversion element Zn is driven.

Further, it should be noted that in FIG. 3, the image signal output portion 2 outputs the low level image signal P22 at the second cycle for white image representation. In this case, the transistor Q2 is not turned on. Consequently, the electrode of the piezoelectric conversion element Z2 is not connected to the ground. Even if the drive voltage circuit 4-2 outputs the drive voltage signal A2 to the piezoelectric conversion element Z2, the piezoelectric conversion element Z2 is not driven and no impulse current A2' flows into the piezoelectric conversion element Z2, as shown in FIG. 3.

In this way, the drive voltage signal is applied to the piezoelectric conversion elements Z1 to Zn during successive intervals d which equals to the period during which the piezoelectric conversion element is driven to reduce the volume of the ink chamber or equals to the duration of the impulse current. Accordingly, the impulse currents A1' to An' flowing into the piezoelectric conversion elements Z1 to Zn do not occur at the same time, enabling the simultaneous drive voltage consumption to be kept at a lower level and thus enabling use of a smaller power source. Also, this makes it possible to suppress noise which is liable to occur due to the superimposition of impulse currents.

In the foregoing embodiment, a drive voltage signal is applied to the piezoelectric conversion elements sequentially at the interval d. Alternatively, the piezoelectric conversion elements may be divided into a plurality of ink ejection groups to apply a drive voltage signal to piezoelectric conversion elements in each group at the interval d. Specifically, the piezoelectric conversion elements are divided into two groups in such a manner that each group has the same number of piezoelectric conversion elements. A drive voltage signal is applied to the first piezoelectric conversion element in each group at a specified timing. In this case, a plurality of impulse currents do not flow in each group at the same time. Also, the piezoelectric conversion elements are divided into groups and drive voltage signals are sent to the groups at the same time. Accordingly, the ejection cycle period can be shortened.

Figure 4:
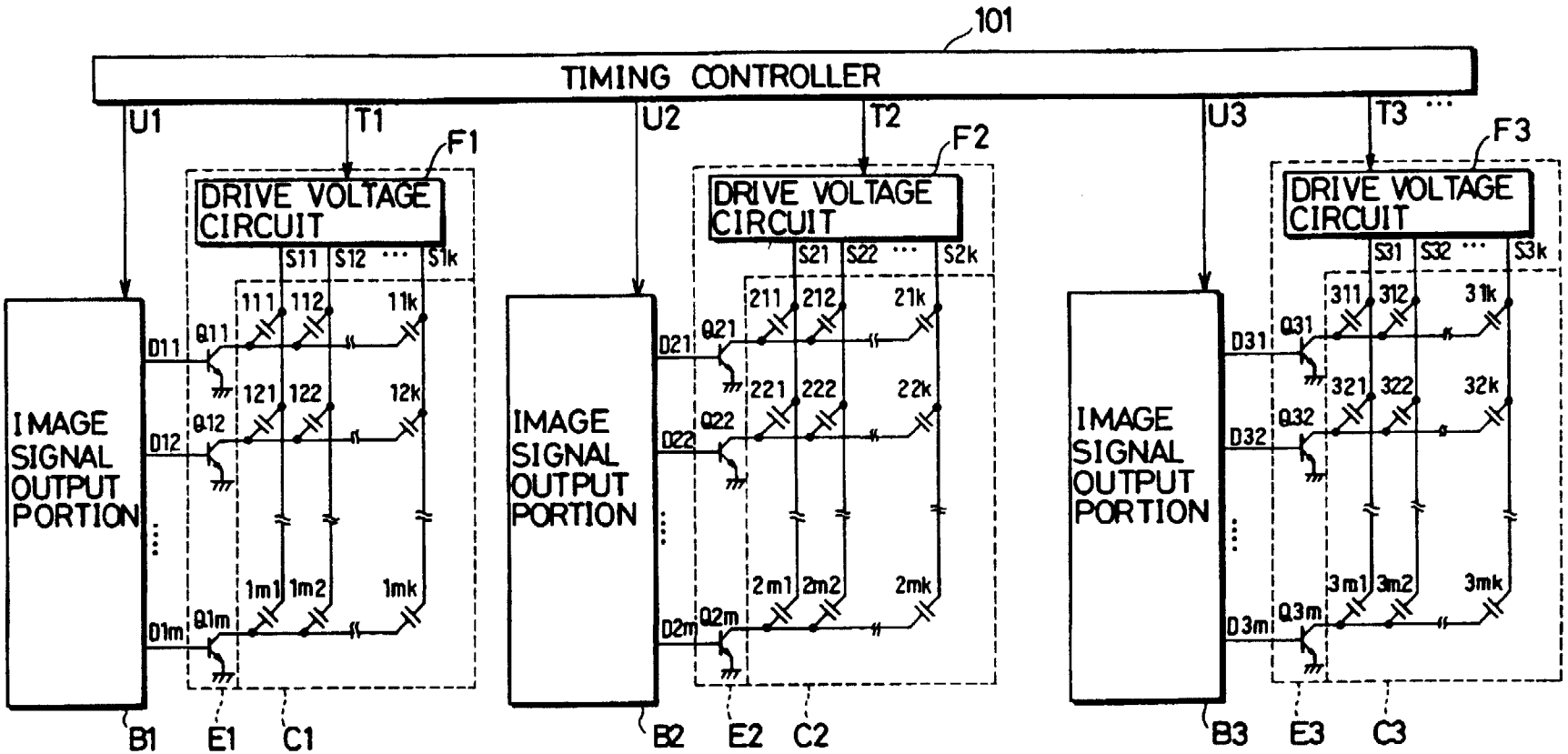
FIG. 4 is a block diagram showing an arrangement of a second ink ejecting device of the present invention.
Figure 5:
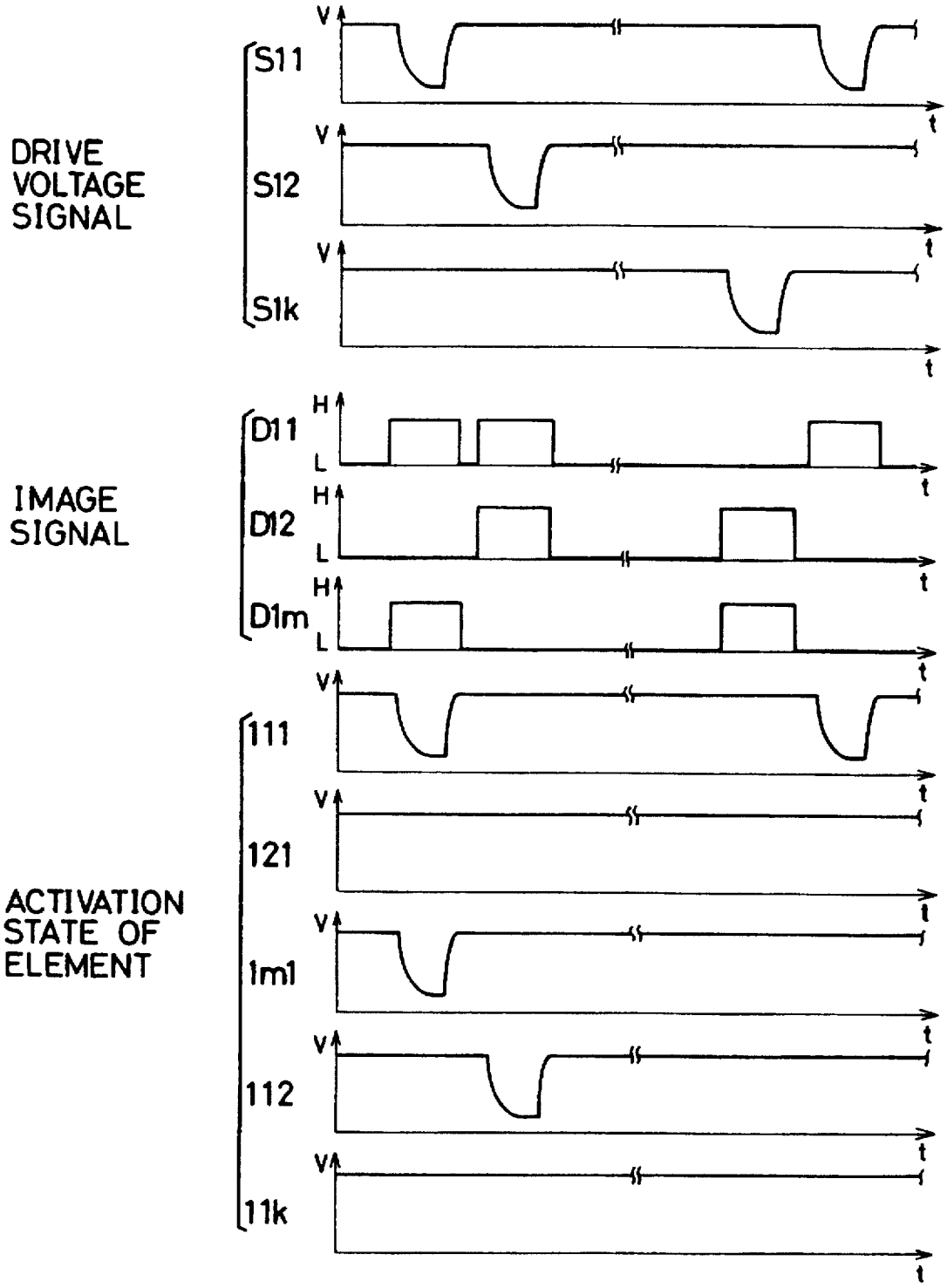
FIG. 5 is a timing chart showing a relationship between drive voltage signals from drive voltage circuits, image signals from an image signal output portion, and activation states of piezoelectric conversion elements in the second ink ejecting device.
Figure 6:
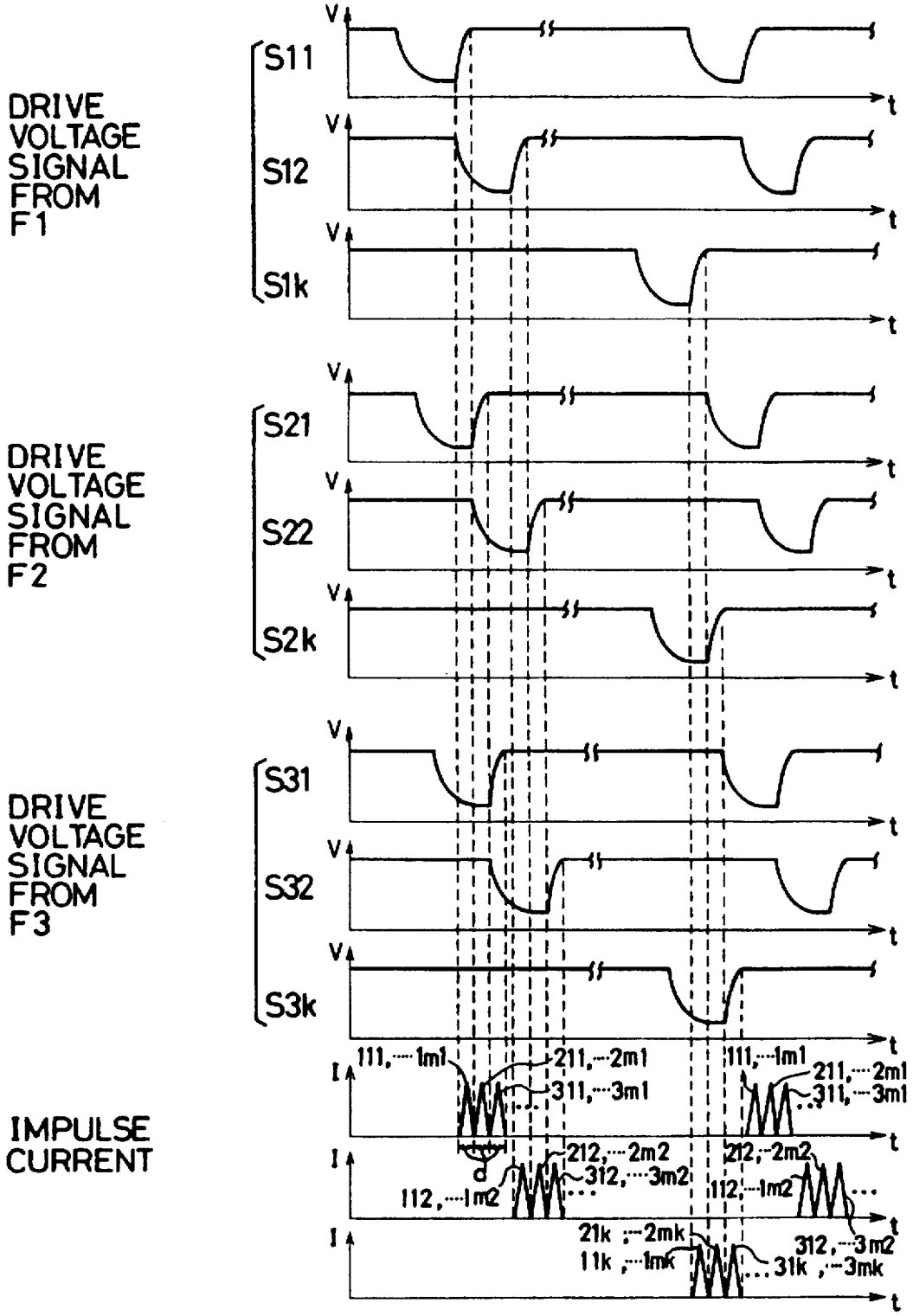
FIG. 6 is a timing chart showing a relationship between drive voltage signals from drive voltage circuits, and impulse currents flowing to piezoelectric conversion elements in the second ink ejecting device.

Next, a second ink ejecting device of the present invention will be described with reference to FIGS. 4 to 6. FIG. 4 is a block diagram showing an arrangement of the second ink ejecting device; FIG. 5 is a timing chart showing a relationship between drive voltage signals from drive voltage circuits, image signals from image signal output portions, and activation states of piezoelectric conversion elements; and FIG. 6 is a timing chart showing a relationship between drive voltage signals from drive voltage circuits, and impulse currents flowing into piezoelectric conversion elements.

This ink ejecting device comprises a timing controller 101, image signal output portions B1, B2, B3, . . . , and Bn, ink ejection groups C1, C2, C3, . . . , and Cn, driving portions E1, E2, E3, . . . , and En. The driving portions E1 to En include drive voltage circuits F1 to Fn, respectively. Each part performs the same function as in the first ink ejecting device.

The timing controller 1 has output ports T1 to Tn, and output ports U1 to Un. The output ports T1 to Tn are connected to the drive voltage circuits F1 to Fn respectively, while the output ports U1 to Un are connected to the image signal output portions B1 to Bn, respectively.

The ink ejection group C1 includes piezoelectric conversion elements. They are arranged in a matrix form of k columns and m rows, i.e., k×m. Further, they are divided into k ink ejection units. In other words, each ink ejection unit includes m piezoelectric conversion elements, specifically, a first ink ejection unit including piezoelectric conversion elements 111 to 1m1; a second ink ejection unit including piezoelectric conversion elements 112 to 1m2, . . . , and k-th ink ejection unit including piezoelectric conversion elements 11k to 1mk.

The driving portion E1 includes the drive voltage circuit F1 and m transistors, i.e., Q11 to Q1m. The drive voltage circuit F1 includes k output ports from which drive voltage signals S11 to S1k are output to respective piezoelectric conversion elements of the first to k-th ink ejection units. Likewise, the image signal output portion B1 includes m output ports from which image signals D11 to D1m are output to the transistors Q11 to Q1m.

More specifically, the drive voltage signal S11 is output to one electrode of each of the piezoelectric conversion elements 111, 121, . . . , and 1m1; the drive voltage signal S12 is output to one electrode of each of the piezoelectric conversion elements 112, 122, . . . , and 1m2; . . . , and the drive voltage signal S1k is output to one electrode of each of the piezoelectric conversion elements 11k, 12k, . . . , and 1mk. In this way, the drive voltage circuit F1 sequentially outputs the drive voltage signals S11 to S1k having a specified waveform, as shown in FIG. 5.

The collector of the transistor Q11 is connected to the piezoelectric conversion elements 111 to 11k, its base is connected to the first output port of the image signal output portion B1, and its emitter is connected to the ground. Likewise, the collector of the transistor Q12 is connected to the piezoelectric conversion elements 121 to 12k, its base is connected to the second output port of the image signal output portion B1, and its emitter is connected to the ground; . . . , and the collector of the transistor Q1m is connected to the piezoelectric conversion elements 1m1 to 1mk, its base is connected to the m-th output port of the image signal output portion B1, and its emitter is connected to the ground. Accordingly, when each transistor is turned on, the other electrode of the corresponding piezoelectric conversion elements is connected to the ground.

The image signal output portion B1 outputs in parallel image signals D11 to D1m from the respective output ports to the bases of the transistors Q11 to Q1m in accordance with a timing signal output from the output port U1 of the timing controller 1.

The ink ejection groups C2 to Cn each have an arrangement identical to that of the ink ejection group C1; the driving portions E2 to En each have an arrangement identical to that of the driving portion E1; and the image signal output portions B2 to Bn each have an arrangement identical to that of the image signal output portion B1.

The timing controller 1 outputs a timing signal sequentially to the drive voltage circuits F1 to Fn in this order at a predetermined interval d. The drive voltage signals S11 to S1k are output from the drive voltage circuits F1 to Fn in accordance with the timing signal. Further, the timing controller 1 outputs a timing signal from the output ports U1 to Un to the image signal output portions B1 to Bn so that image signals are output in parallel in synchronism with the output of the corresponding drive voltage signal.

Next, an operation of the driving portion E1 will be described with reference to FIG. 5. The drive voltage signals S11 to S1k having the specified waveform are output sequentially to the piezoelectric conversion elements 111, 121, . . . , and 1m1 in the first ink ejection unit from the output ports of the drive voltage circuit F1 in accordance with the timing signal T1 from the timing controller 1.

On the other hand, the image signal output portion B1 outputs image signals D11 to D1m to the transistors Q11 to Q1m in parallel in accordance with the timing signal U1 from the timing controller 1. Specifically, as shown in FIG. 5, at the same time when the drive voltage signal S11 is output, high level image signals D11 and D1m and a low level image signal D12 are output. The piezoelectric conversion elements 111 and 1m1 are activated because the corresponding transistors Q1 and Q1m receive the high level image signals D11 and D1m to connect their respective emitters to the ground. Consequently, they eject ink through their respective ejection nozzles. However, the piezoelectric conversion element 121 is not activated because the corresponding transistor Q12 receives the low image signal D12 and does not connect the emitter to the ground. Accordingly, the element 121 ejects no ink.

Similarly, the image signal output portion B1 outputs image signals D11 to D1m to the transistor Q11 to Q1m in synchronism with the output of the drive voltage signal S12 to the piezoelectric conversion elements 112 to 1m2 in the second ink ejection unit. Specifically, as shown in FIG. 5, when the drive voltage signal S12 is output from the drive voltage circuit F1, high level image signals D11 and D12 and a low level image signal D1m are output. Accordingly, the piezoelectric conversion elements 112 and 122 are activated because the corresponding transistors Q11 and Q12 receive the high level image signals D11 and D12 to connect their respective emitters to the ground, thereby ejecting ink through their respective ejection nozzles. However, the piezoelectric conversion element 1m2 is not activated because the corresponding transistor Q1m receives the low image signal D1m and does not connect the emitter to the ground, thereby not ejecting ink.

Finally, the image signal output portion B1 outputs image signals D11 to D1m to the transistors Q11 to Q1m in parallel in synchronism with the output of the drive voltage signal S1k to the piezoelectric conversion elements 1m1 to 1mk in the k-th ink ejection unit. Specifically, as shown in FIG. 5, when the voltage signal S1k is output from the drive voltage circuit F1, a low level image signal D11 and high level image signals D12 and D1m are output. Accordingly, the piezoelectric conversion elements 12k and 1mk are activated because the corresponding transistors Q12 and Q1m receive the high level image signals D12 and D1m to connect their respective emitters to the ground, thereby ejecting ink through their respective ejection nozzles. However, the piezoelectric conversion element 11k is not activated because the corresponding transistor Q11 receives the low image signal D11 and does not connect the emitter to the ground, thereby not ejecting ink.

In this way, the image signals D11 to D1m are output in parallel from the first to m-th output ports of the image signal output portion B1 in synchronism with the output of the drive voltage signal S11 (to S1k) to the piezoelectric conversion elements in the first to k-th ink ejection units. Accordingly, the piezoelectric conversion elements in one ink ejection unit are activated at a different time from those in another ink ejection unit.

Operation of the driving portions E2 to En is identical to that of the driving portion E1. Accordingly, a description of their operation will be omitted.

Next, timing control of the driving portions E1 to En will be described with reference to FIG. 6.

Drive voltage signals are sequentially output from the respective first to k-th output ports of the drive voltage circuits F1 to Fn in accordance with a timing signal which is output from the output ports T1 to Tn of the timing controller 1 during respective intervals d. For example, voltage signals S11, S21, S31, . . . , and Sn1 are output from the respective first output ports of the drive voltage circuits F1 to Fn during the respective successive intervals d; voltage signals S12, S22, S32, . . . , and Sn2 are output from the respective second output ports of the drive voltage circuits F1 to Fn during respective successive intervals d; . . . ; and voltage signals S1k, S2k, S3k, . . . , and Snk are output from the respective k-th output ports of the drive voltage circuits F1 to Fn during respective successive intervals d.

In other words, drive voltage signals are applied to the piezoelectric conversion elements of one of the respective first to k-th ink ejection units of the driving portions E1 to En at the interval d. The interval d is equal to the duration of an impulse current flowing into the piezoelectric conversion element. There is no activation overlap among the ink ejection units. Accordingly, the simultaneous drive voltage consumption can be kept at a lower level. This enables use of a smaller power source, which reduces the size of ink ejecting device.

The number n of driving portions, the number k of output ports of the drive voltage circuit of each driving portion, and the number m of output ports of the image signal output portion of each driving portion are determined as follows in the case of an ink ejecting device having 2000 ejection nozzles, i.e., 2000 piezoelectric conversion elements, as an example.

First, calculated is the number n' of impulse currents which may be generated without overlap in a possible ink ejection period. The possible ink ejection period depends on performance characteristics of the piezoelectric conversion element or other parts. The calculation of the impulse current number n' can be represented by the following equation:

$$n'=1/(f\times d),$$

wherein f denotes a possible ink ejection frequency (kHz) and d denotes a duration (sec) of the impulse current flowing into the piezoelectric conversion element. For example, in the case where d is 10 μsec. and f is 5 kHz, the number n' becomes 20.

On the other hand, the number k of output ports of the drive voltage circuit is determined by calculating how many drive voltage signals may be generated without overlap in the possible ink ejection period. Specifically, the number k is obtained by executing the equation:

$$k=1/(f\times\lambda),$$

wherein λ denotes a duration of the drive voltage signal. For example, in the case where λ is 50 μsec. and f is 5 kHz, the drive voltage signal port number k becomes 4. It should be noted that if the obtained quotient has any figure after the decimal point, the figure after the decimal point will be ignored.

The number n of driving portions can be obtained by executing the equation: $n=n'/k$, because of the fact that one ink ejection unit of one driving portion should be driven from one ink ejection unit of another driving portion at an interval d equal to the impulse current duration. Accordingly, in the case where n' is 20 and k is 4, the driving portion number n becomes 5.

In the case of 2000 piezoelectric conversion elements, accordingly, each driving portion is allotted with 400 piezoelectric conversion elements as shown in the calculation: 2000/4=400. Further, in the matrix of k×m, since the drive voltage signal port number k is 4, the image signal output port number m is obtained as shown in the calculation:

400/4=100. In other words, the maximum number of simultaneously driven piezoelectric conversion elements in each driving portion is reduced to 100, which is a considerably smaller number compared to 500 piezoelectric conversion elements which are driven at the same time in the conventional ink ejecting device having four.

Next, a third ink ejecting device of the present invention will be described with reference to FIGS. 7 and 8. The third ink ejecting device is adapted for driving a matrix-arranged piezoelectric conversion elements. In the third ink ejecting device, the piezoelectric conversion element matrix may be driven not only by entirely driving a number of ink ejection units one after another at a specified interval as the first embodiment but also by combining a specified number of ink ejection units into one ink ejecting group and driving a number of ink ejecting groups one after another at a specified interval as the second embodiment. However, the following description will be made about the entire driving manner.

Figure 7:
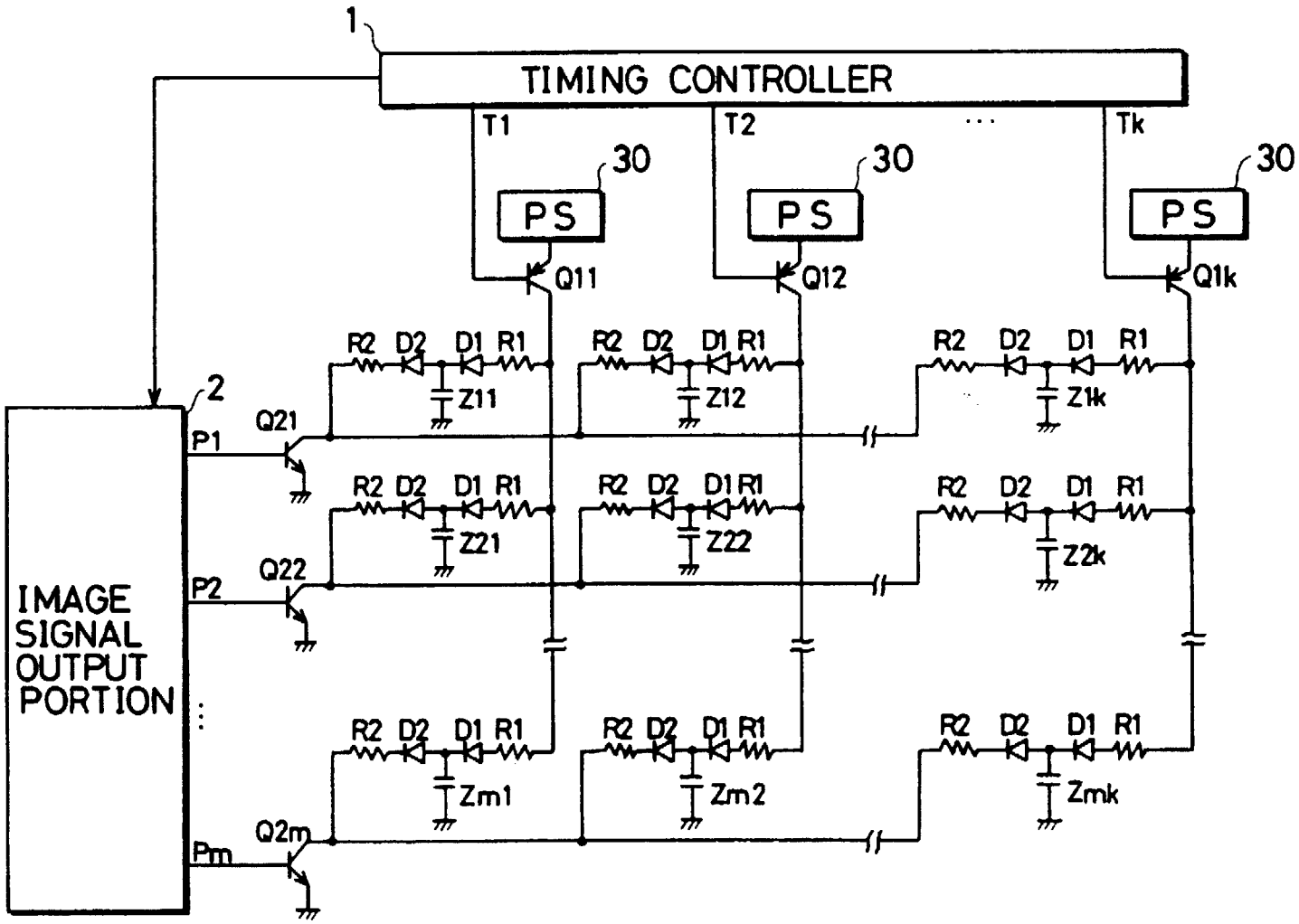
FIG. 7 is a circuit block diagram showing a construction of a third ink ejecting device.

FIG. 7 is a circuit block diagram showing a construction of the third ink ejecting device. FIG. 8 is a timing chart showing a relationship between an operation of transistors and a voltage in piezoelectric conversion elements.

The third ink ejecting device comprises a timing controller 1, an image signal output portion 2, an ink ejecting portion, and a drive portion. The ink ejecting portion includes piezoelectric conversion elements Z11 to Z1k, Z21 to Z2k, . . . , and Zm1 to Zmk. They are arranged in a matrix form of k columns and m rows, i.e., m×k. Each piezoelectric conversion element is provided in a side wall of an ink chamber of an ink ejection element. When a voltage is applied to a piezoelectric conversion element, the ink chamber is deformed and brought into a pressurized state, thereby ejecting ink from the ink chamber through an ejection nozzle. The voltage will be described later. Each of the piezoelectric conversion elements Z11 to Z1k, Z21 to Z2k, . . . , and Zm1 to Zmk has two electrodes. One of the two electrodes is connected to the ground.

The drive portion includes power source 30 which supplies a bias voltage V0, voltage transistors Q11 to Q1k, and image transistors Q21 to Q2m. Each transistor is connected to the other electrode (not connected to the ground) of each of the corresponding piezoelectric conversion elements by way of a resistor and a diode. The transistors are adapted for causing a voltage in the corresponding piezoelectric conversion elements.

The voltage transistor Q11 has an emitter connected to the power source 3, a base connected to an output port T1 of the timing controller 1, and a collector connected to the piezoelectric conversion elements Z11, Z21, . . . , and Zm1 via corresponding series circuits each including a resistor R1 and a diode D1. The diode D1 is connected to the other electrode of the corresponding piezoelectric conversion element in the forward direction. The voltage transistors Q12 to Q1k have an arrangement similar to the voltage transistors Q11. Specifically, the voltage transistors Q12 to Q1k respectively have emitters connected to the power source 3, bases connected output ports T2 to Tk of the timing controller 1, and collectors connected to the other electrodes of the corresponding piezoelectric conversion elements via series circuits each including a resistor R1 and a diode D1.

The image transistor Q21 has a collector connected to the piezoelectric conversion elements Z11, Z12, . . . , and Z1k via corresponding series circuits each including a resistor R2 and a diode D2, a base connected to an output port P1 of the image signal output portion 2, and an emitter connected to the ground. The diode D2 is connected to the other electrode of the corresponding piezoelectric conversion element in a reverse direction. The image transistors Q22 to Q2m have an arrangement similar to the image transistor Q21. Specifically, the image transistors Q22 to Q2m respectively have collectors connected to the other electrodes of the corresponding piezoelectric conversion elements via series circuits each including a resistor R2 and a diode D2, bases connected to output ports P2 to Pm of the image signal output portion 2, and emitters connected to the ground.

The image signal output portion 2 outputs image signals in parallel to the respective bases of the image transistors Q21 to Q2m from the output ports P1 to Pm as timed with a timing signal output from the timing controller 1. The image signal is defined by a pulse having a specified width.

The timing controller 1 turns on and off the image transistors Q21 to Q2m in synchronism with the output of image signals. When an image signal for black image representation is output, the image transistors Q21 to Q2m are turned on. When an image signal for white image representation is output, the image transistors Q21 to Q2m are kept in the OFF-state. Image signals which are to be output are produced by an unillustrated image reader or image generator, such as, personal computer.

The timing controller 1 usually outputs a low level signal from the output ports T1 to Tk to keep the corresponding voltage transistors in the ON-state. In synchronism with the output of image signals, the timing controller 1 outputs a high level signal of a specified pulse width from the output ports T1 to Tk one after another to turn the voltage transistors Q11 to Q1k off.

In the usual state, the voltage transistors Q11 to Q1k are kept in the ON-state by the low level signal from the timing controller 1 to thereby apply the bias voltage V0 to the piezoelectric conversion elements. However, when receiving the high level signal from the timing controller 1, the voltage transistors Q11 to Q1k turn off for a specified duration corresponding to the specified pulse width of the high level signal. On the other hand, when receiving an image signal from the image signal output portion 2, the image transistors Q21 to Q2m turn on for a specified duration corresponding to the specified pulse width of the image signal. Consequently, the application of bias voltage VO to the piezoelectric conversion element is suspended, and an electric charge goes out from the piezoelectric conversion element through the corresponding series circuit of the resistor R2 and diode D2, resulting in a decrease in the voltage in the piezoelectric conversion element.

Subsequently, when the voltage transistors Q11 to Q1k are turned on and the image transistors Q21 to Q2m are turned off, the voltage in the piezoelectric conversion element is rapidly increased to the bias voltage level VO. This change, i.e., decrease and rapid increase, in the voltage in the piezoelectric conversion element produces a voltage for activating the piezoelectric conversion element for ink ejection. In other words, when the voltage in the piezoelectric conversion element is rapidly raised after the temporary fall, the piezoelectric conversion element is deformed in such a manner that the ink chamber is first expanded, then shrinks to thereby eject ink from the ink chamber through the ejection nozzle.

For example, when the image transistors Q21 to Q2m are turned on in synchronism with the turning off of the voltage transistor Q11, an electric charge goes out from the piezoelectric conversion elements Z11 to Zm1 through the corresponding series circuits each including the resistor R2 and the diode D2 to thereby decrease the voltage in the piezoelectric conversion elements to a voltage level V1.

Subsequently, when the image transistors Q21 to Q2m are turned off in synchronism with the turning on of the voltage transistor Q11, the discharging of the piezoelectric conversion elements Z11 to Z1m is suspended, and the respective piezoelectric conversion elements are applied with the bias voltage V0 of the power source 3. Consequently, a voltage is generated by the temporary fall and the following rapid rise of the voltage in the piezoelectric conversion elements to thereby cause an ink ejection force.

However, it should be noted that there is a problem in this driving method. Specifically, when the image transistors Q21 to Q2m are turned on in the state that one of the voltage transistors, e.g., Q11, is in the OFF-state and the other voltage transistors, e.g., Q12 to Q1k, are in the ON-state, not only an electric charge goes out from the piezoelectric conversion elements which are wired to the voltage transistor Q11, but also an electric charge goes out from the piezoelectric conversion elements which are wired to the remaining voltage transistors Q12 to Q1k. However, since the bias voltage VO is continued to be applied to the electric conversion elements wired to the remaining transistors Q12 to Q1k, the voltage in the piezoelectric conversion elements wired to the voltage transistors Q12 to Q1k decreases to a divided voltage V2 which is obtained by dividing the bias voltage V0 by the resistor R1 and the resistor R2. Thereafter, when the image transistors Q21 to Q2m are turned off, the voltage in the piezoelectric conversion elements wired to the voltage transistors Q12 to Q1k is rapidly increased from the divided voltage V2 to the bias voltage V0.

In this ink ejecting device, to prevent ink from going out due to the voltage difference between V2 to V0, the resistors R1 and R2 are made to have such a resistance as to reduce the voltage difference to a value which does not cause ink ejection.

Next, an operation of the piezoelectric conversion elements Z11, Z12 and Z1k will be described with reference to FIG. 8. In the usual state, the image transistor is in the OFF-state, the voltage transistor is in the ON-state, and the bias voltage V0 is applied to the piezoelectric conversion elements.

First, the voltage transistor Q11 is turned off. As timed with the turning off of the voltage transistors Q11, the image transistor Q21 is turned on in response to an image signal for black image representation. Consequently, the application of the bias voltage V0 to the piezoelectric conversion element Z11 is suspended while an electric charge goes out from the piezoelectric conversion element Z11. The voltage V11 applied to the piezoelectric conversion element Z11 is decreased to the voltage level V1.

Also, with the turn on of the image transistor Q21, an electric discharge occurs in the piezoelectric conversion elements Z12 and Z1k. As a result, the voltages V12 and V1k applied to the piezoelectric conversion elements Z12 and Z1k are also decreased. However, since the voltage transistors Q12 and Q1k are kept in the ON-state and the bias voltage V0 is continued to be applied to the piezoelectric conversion elements Z12 and Z1k, the voltages V12 and V1k are not decreased less than the level divided voltage V2 (>V1).

When the voltage transistor Q11 is turned on and the image transistor Q21 is turned off, the discharging of the piezoelectric conversion element Z11 is suspended, and the bias voltage V0 is applied to the piezoelectric conversion element Z11. Accordingly, the voltage V11 applied to the piezoelectric conversion element Z11 is rapidly increased to the voltage level V0, with the result that a voltage change (V0–V1) is applied to the piezoelectric conversion element Z11. Consequently, the voltage V11 activates the piezoelectric conversion element Z11 to eject ink through the nozzle. On the other hand, when the voltage transistor Q11 is turned on and the image transistor Q21 is turned off, the discharging of the piezoelectric conversion elements Z12 and Z1k is also suspended. Accordingly, the voltages V12 and V1k are increased to the voltage level V0 and a voltage change (V0–V2) is applied to the piezoelectric conversion elements Z12 and Z1k. However, since the voltage change (V0–V2) is set to be so small as not to cause an ink ejection, even by deformation of the piezoelectric conversion elements Z12 and Z1k, ink is not ejected through the nozzle of the piezoelectric conversion elements Z12 and Z1k.

With a second timing signal, the voltage transistor Q12 is turned off while the image transistor Q21 is turned on in response to an image signal for black image representation for the piezoelectric conversion element Z12. Accordingly, the application of the bias voltage V0 to the piezoelectric conversion element Z12 is suspended, and an electric charge goes out from the piezoelectric conversion element Z12 upon turning on of the image transistor Q21. The voltage V12 applied to the piezoelectric conversion element Z12 is decreased to the voltage level V1. Further, the turning on of the image transistor Q21 causes an electric discharge from the piezoelectric conversion elements Z11 and Z1k. As a result, the voltages V11 and V1k, which are respectively applied to the piezoelectric conversion elements Z11 and Z1k, decrease. However, since the voltage transistors Q11 and Q1k are kept in the ON-state and the bias voltage V0 is continued to be applied to the piezoelectric conversion elements Z11 and Z1k, the voltages V11 and V1k decrease to the level divided voltage V2.

Subsequently, when the voltage transistor Q12 is turned on and the image transistor Q21 is turned off, the discharging of the piezoelectric conversion element Z12 is suspended, and the bias voltage V0 is applied to the piezoelectric conversion element Z12. Accordingly, the voltage V12 is rapidly increased to the level V0, and a voltage change (V0–V1) is applied to the piezoelectric conversion element Z12 to thereby eject ink through its nozzle. On the other hand, when the voltage transistor Q12 is turned on and the image transistor Q21 is turned off, the discharging of the piezoelectric conversion elements Z11 and Z1k is also suspended, the voltages V11 and V1k are rapidly raised to the level V0, and a voltage change (V0–V2) is applied to the piezoelectric conversion elements V11 and V1k. However, since the voltage level (V0–V2) is set to be so small as not to cause an ink ejection even by the deformation of the piezoelectric conversion elements Z11 and Z1k, ink is not ejected through the respective nozzles of the piezoelectric conversion elements.

With a k-th timing signal, when the voltage transistor Q1k is turned off and the image transistor Q21 is turned on in response to an image signal for black image representation for the piezoelectric conversion element Q1k, ink ejection is activated in the piezoelectric conversion element Z1k but ink is not ejected from the piezoelectric conversion elements Z11 and Z12.

In this way, the large number of piezoelectric conversion elements of k×m can be driven in the "after-receding ejection" manner, which ensures the high ejection performance. Also, the large number of piezoelectric conversion elements of k×m can be efficiently and accurately activated by the small number of transistors of k+m.

The combination of the resistors R1 and R2 makes it possible to reliably keep ink from going out from ink ejection elements wired to voltage transistors in the ON-state even when the image transistors are turned on because the resistor combination suppresses the voltage decrease in the corresponding piezoelectric conversion elements to so small a level as not to break the surface tension of ink accommodated in the ink chamber.

Further, one of the two electrodes of each piezoelectric conversion element is connected to the ground, which accordingly makes it possible to simplify the construction of the drive portion of piezoelectric conversion elements.

In the embodiment of FIG. 7, for the sake of easier understanding, the power source 30 is provided for each voltage transistor. However, it should be appreciated that a single power source 30 may be provided for a plurality of voltage transistors.

Next, several modifications of the third ink ejecting device will be described with reference to FIGS. 9 to 14. A first modification is shown in FIGS. 9 and 10; a second modification in FIGS. 11 and 12; and a third modification in FIGS. 13 and 14.

Figure 9:
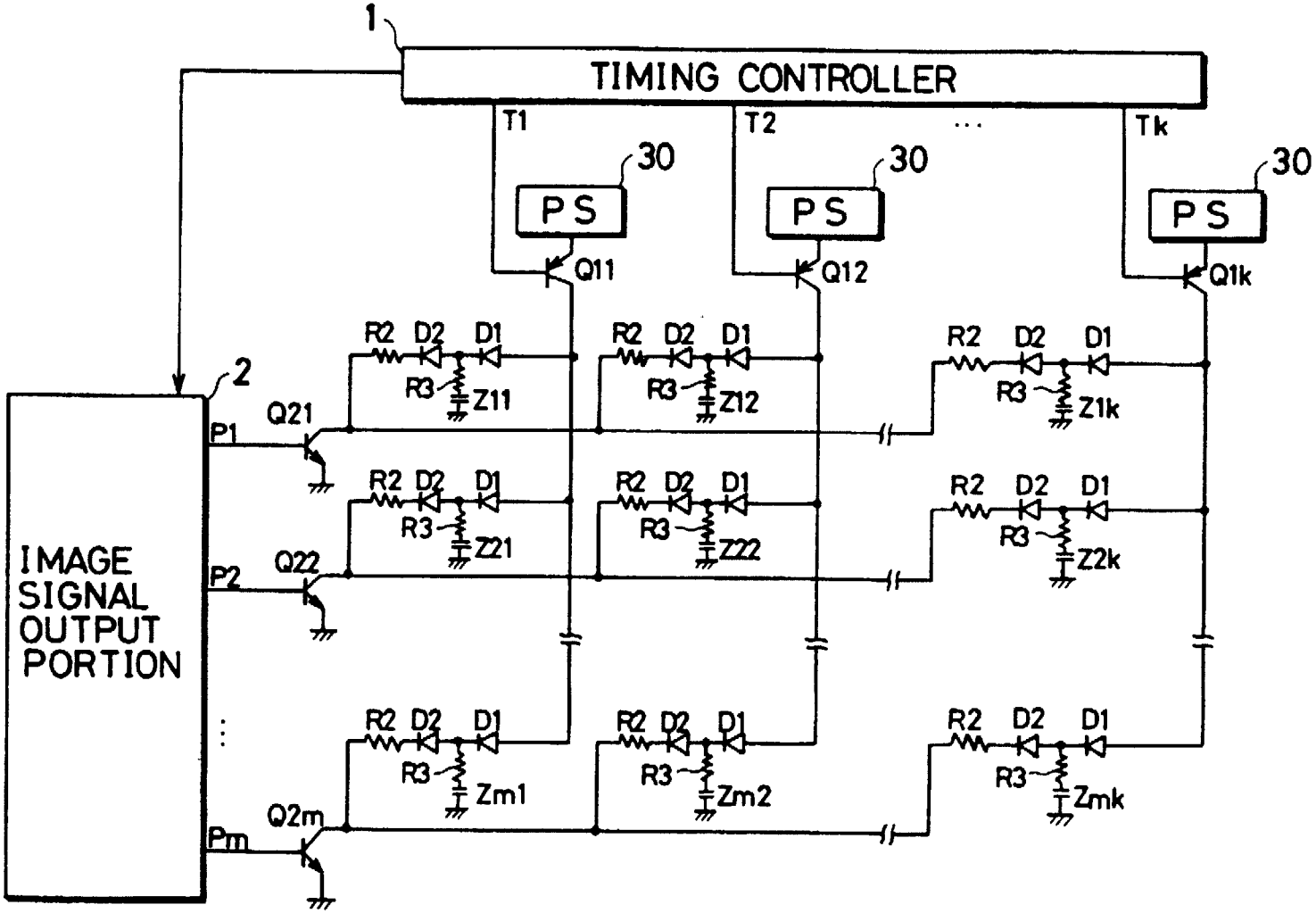
FIG. 9 is a circuit block diagram showing a construction of a first modification of the third ink ejecting device.
Figure 10:
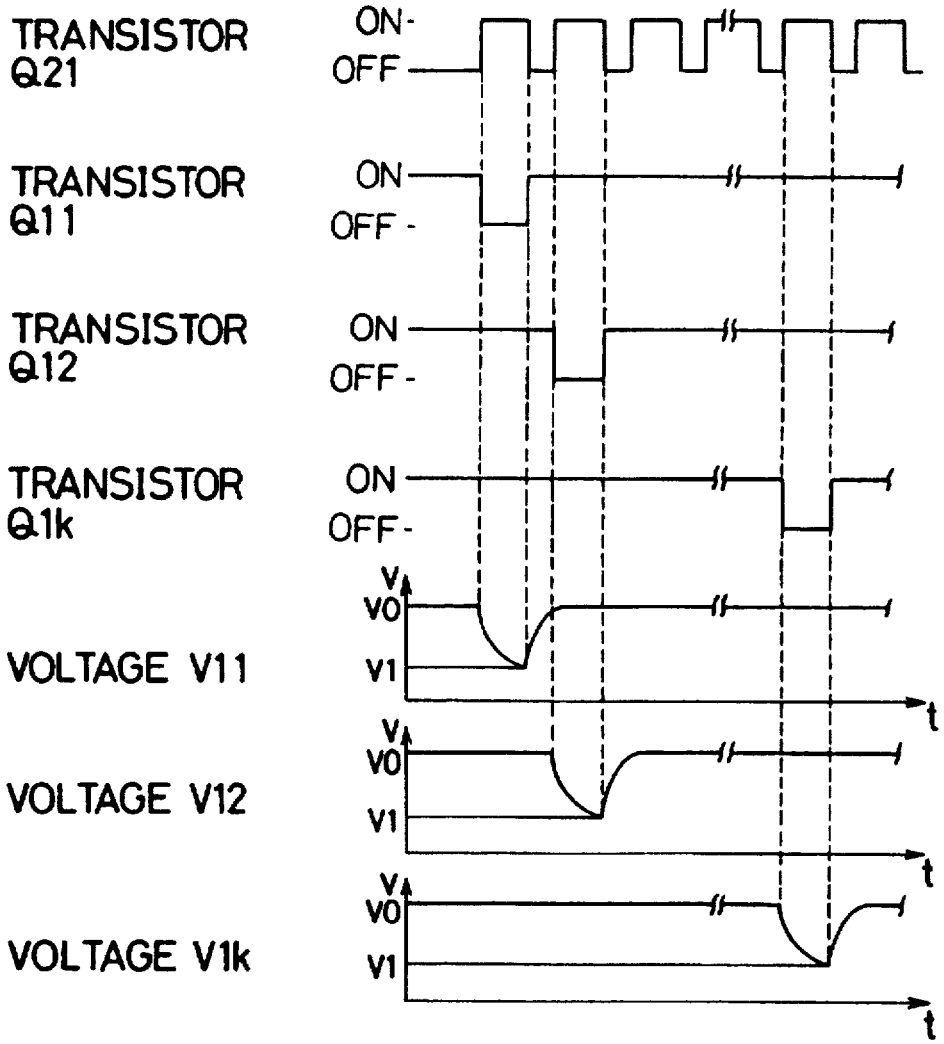
FIG. 10 is a timing chart showing a relationship between an operation of transistors and a voltage in piezoelectric conversion elements of the first modification.

FIG. 9 is a circuit block diagram showing a construction of the first modification. FIG. 10 is a timing chart showing a relationship between an operation of transistors and a voltage in piezoelectric conversion elements.

In FIG. 9, in place of the provision of the resistor R1 in FIG. 7, a resistor R3 is provided between one electrode of each piezoelectric conversion element and a cathode of the diode D1. The resistor R3 is used for permitting a regulated electric current to flow into the piezoelectric conversion element. With this arrangement, for example, when the voltage transistor Q12 is turned on, the bias voltage V0 of the power source 30 is applied to the piezoelectric conversion element Z12.

An operation of the piezoelectric conversion elements Z11, Z12 and Z1k in this modification will be described with reference to FIG. 10. In the usual state, similar to the operation in FIG. 8, the image transistor is in the OFF-state while the voltage transistor is in the ON-state to apply the bias voltage V0 to the piezoelectric conversion elements.

With a first timing signal, the voltage transistor Q11 is turned off and the image transistor Q21 is turned on in response to an image signal for black image representation for the piezoelectric conversion element Z11. Consequently, the application of the bias voltage V0 to the piezoelectric conversion element Z11 is suspended, and an electric charge goes out from the piezoelectric conversion element Z11 upon the turning on of the image transistor Q21. A voltage V11 applied to the piezoelectric conversion element Z11 is decreased to the voltage level V1. On the other hand, the voltage transistors Q12 and Q1k are kept in the ON-state. Accordingly, although the turning on of the image transistor Q21 causes an electric discharge in the piezoelectric conversion elements Z12 and Z1k, voltages V12 and V1k are substantially maintained at the voltage level V0 because no resistor is between the power source 30 and the piezoelectric conversion elements Z12, Z1k, and the continuous application of the bias voltage from the power source 30 is effected.

Subsequently, upon the voltage transistor Q11 being turned on and the image transistor Q21 being turned off, the discharge in the piezoelectric conversion element Z11 is stopped. The bias voltage V0 applied to the piezoelectric conversion element Z11 rapidly restores the piezoelectric conversion element Z11 to the voltage level V0, and an activation voltage charge (V0–V1) in the piezoelectric conversion element Z11 thereby ejects ink through the nozzle. On the other hand, the voltages V12 and V1k applied to the piezoelectric conversion elements Z12 and Z1k are substantially kept at the voltage level V0, which accordingly holds ink from ejecting.

Similarly, when the voltage transistor Q12 (Q1k) is turned off and image transistors Q21 to Q2m are turned on, ink is ejected through their corresponding nozzles.

In this modification, the resistor R1 is not provided. Accordingly, the voltage applied to each piezoelectric conversion element is kept at the voltage level V0 even when the image transistors is turned on as the voltage transistors are held in the ON-state. More efficient ink ejection can be performed in a simpler construction.

Figure 11:
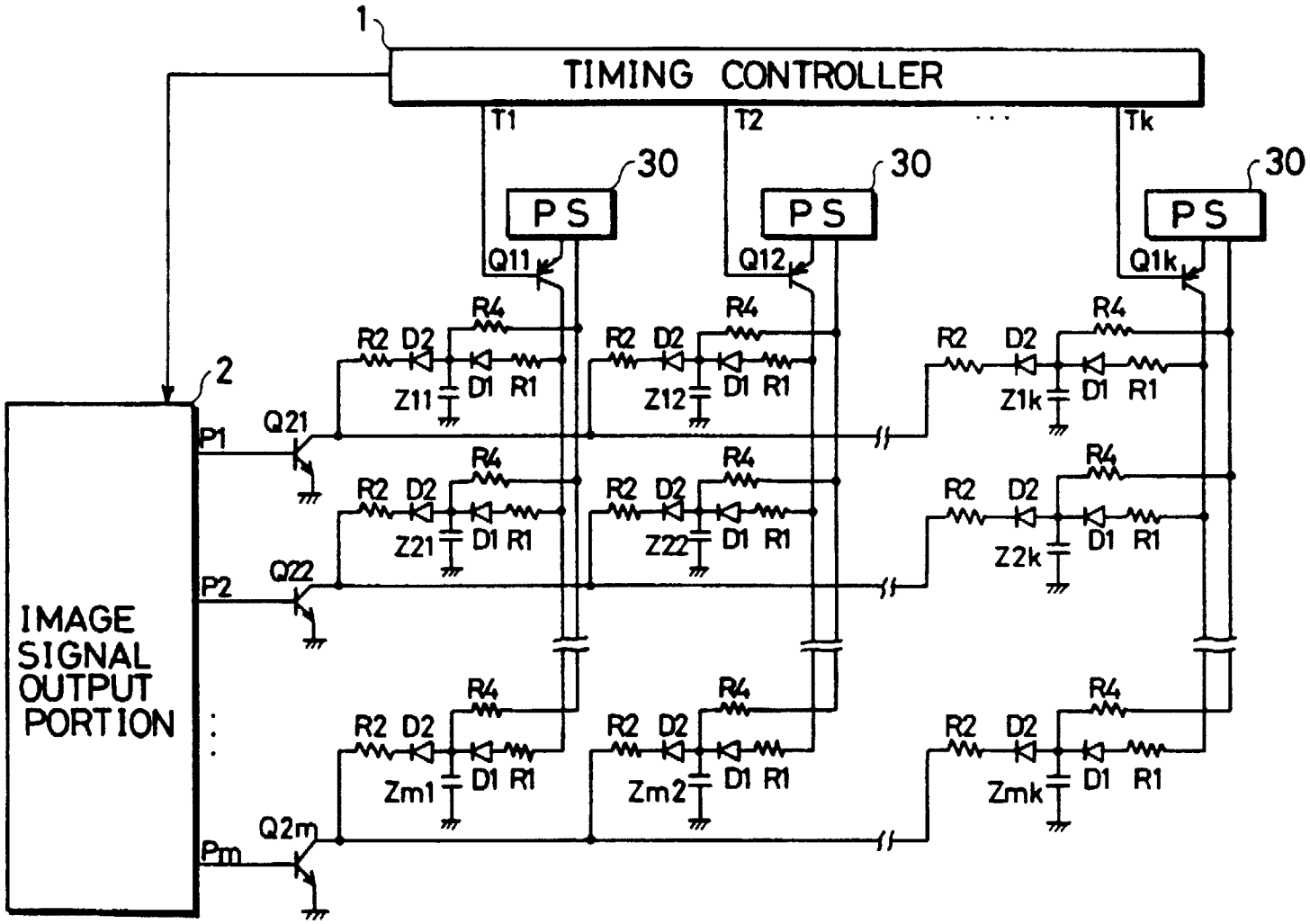
FIG. 11 is a circuit block diagram showing a construction of a second modification of the third ink ejecting device.
Figure 12:
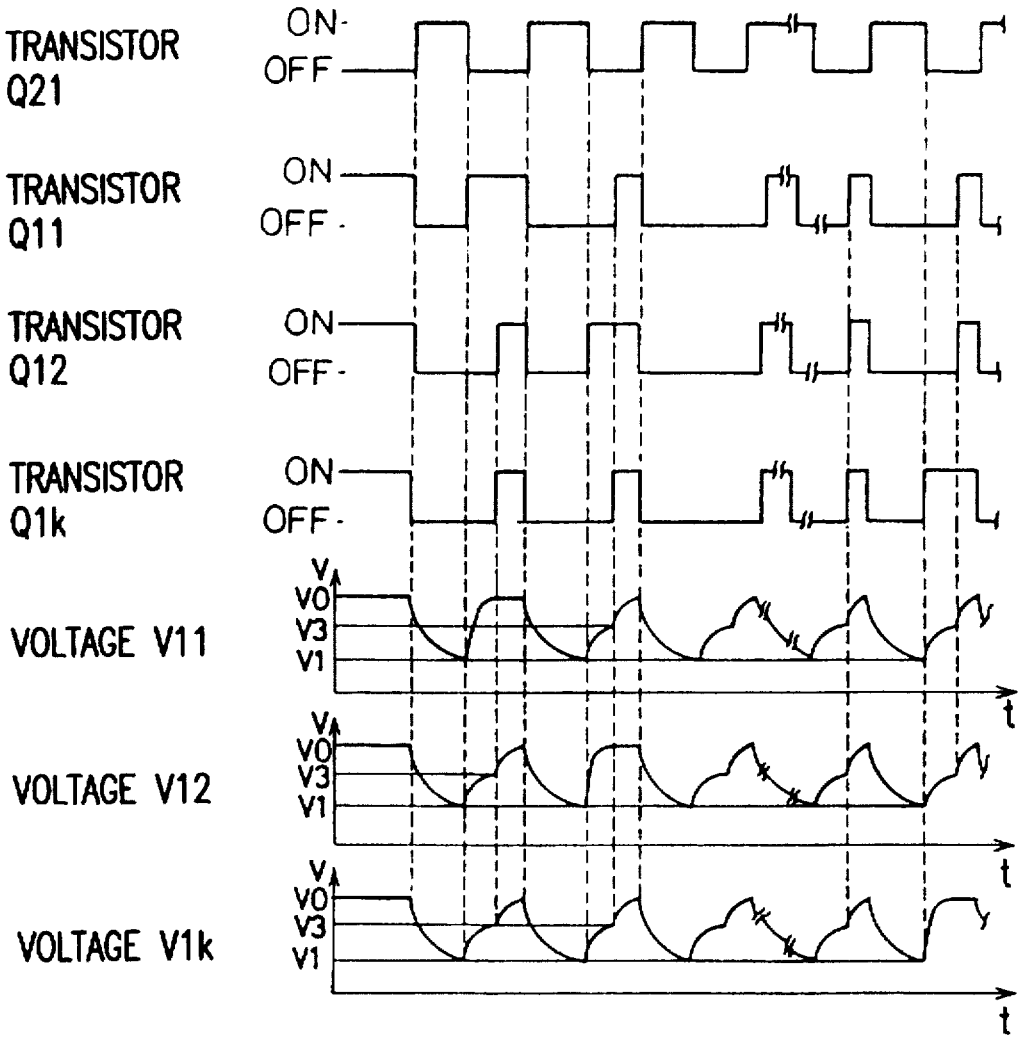
FIG. 12 is a timing chart showing a relationship between an operation of transistors and a voltage in piezoelectric conversion elements of the second modification.

FIG. 11 is a circuit block diagram showing a construction of the second modification. FIG. 12 is a timing chart showing a relationship between an operation of transistors and a voltage in piezoelectric conversion elements in the second modification.

In the second modification, a resistor R4 is additionally provided. The resistor R4 is connected between the one electrode of each of the piezoelectric conversion elements which is not grounded and the power source 30 to raise the voltage at the one electrode of the piezoelectric conversion element to the voltage level V0 of the power source 30.

Figure 8:
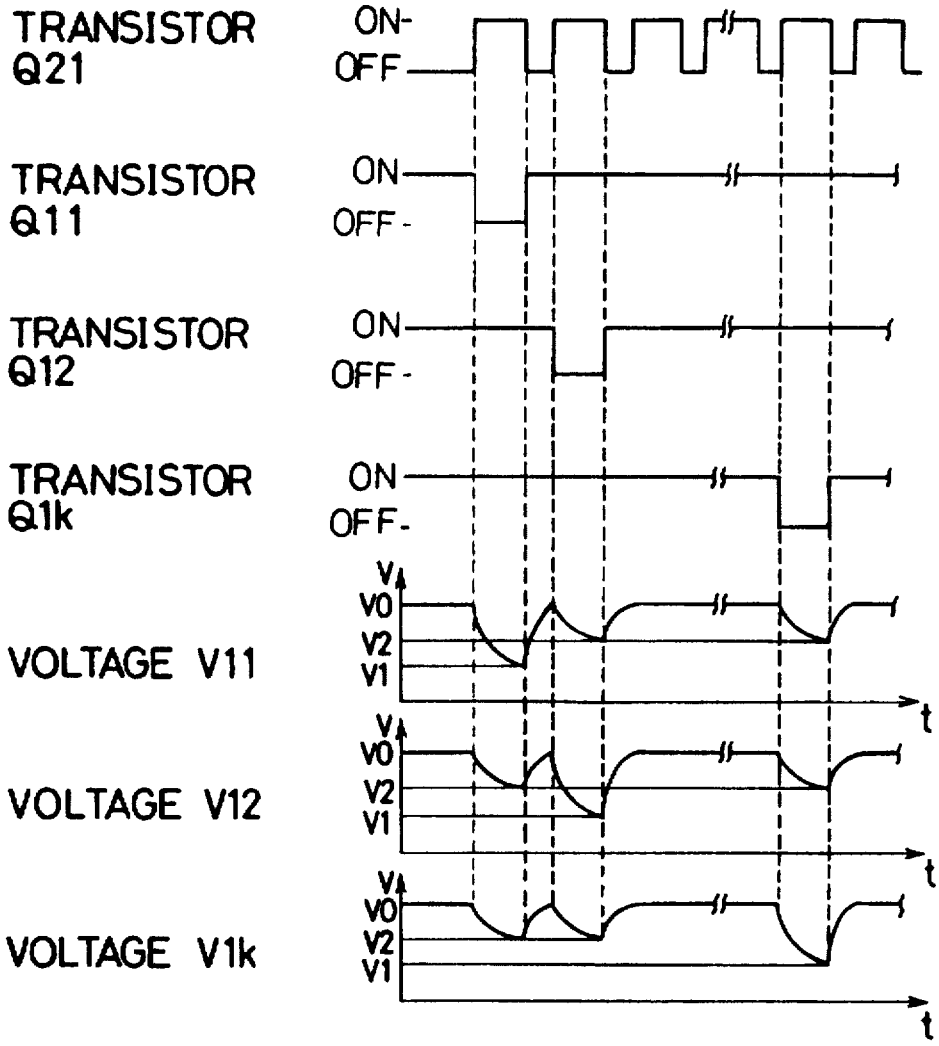
FIG. 8 is a timing chart showing a relationship between an operation of transistors and a voltage in piezoelectric conversion elements of the third ink ejecting device.

In the embodiment shown in FIG. 8, the timing controller 1 renders one of the voltage transistors Q11 to Q1k turned off while holding the other voltage transistors in the ON-state. The turning off is executed at a specified interval. This operation is called "dynamic scanning".

However, in this modification, as shown in FIG. 12, even when one of the voltage transistors Q11 to Q1k is turned off or dynamic-scanned, the other voltage transistors are turned off. More specifically, voltage transistors Q11 to Q1k which are not dynamic-scanned are turned off for a first duration longer than the pulse width of an image signal from the image transistors Q21 to Q2m. A voltage transistor Q11 (to Q1k), which is dynamic-scanned, is turned off for a second duration equal to the pulse width of an image signal from the image transistors Q21 to Q2m.

In the second modification, when not dynamic-scanned, voltage transistors Q11 to Q1k are turned on after image transistors Q21 to Q2m are turned off. However, the voltage in the piezoelectric conversion elements starts increasing via the resistor R4 immediately after the image transistors Q21 to Q2m are turned off, and then rises to a voltage level V3 (>V1) immediately before the voltage transistors Q11 to Q1k are turned on.

Accordingly, the rise in the activation voltage in the piezoelectric conversion elements wired to the not dynamic-scanned voltage transistors is relatively moderate. In other words, the pressure in the ink chamber gradually rises, thereby eliminating the likelihood that the surface tension of ink breaks up and ink goes out of the ink chamber. The resistor R4 is made to have such a resistance as to assure the moderate rise from the voltage V1 to the voltage V3.

Next, an operation of the piezoelectric conversion elements Z11, Z12 and Z1k in this modification will be described with reference to FIG. 12. In the usual state, similar to the embodiment shown in FIG. 8, the image transistor is in the OFF-state while the voltage transistor is in the ON-state, and the bias voltage V0 is applied to the piezoelectric conversion elements. First, the voltage transistors Q11, Q12 and Q1k are turned off and the image transistor Q21 is simultaneously turned on in response to an image signal for black image representation corresponding for the piezoelectric conversion element Z11. The application of the bias voltage V0 to the piezoelectric conversion elements Z11, Z12 and Z1k is suspended, and an electric charge goes out from the piezoelectric conversion elements Z11, Z12 and Z1k upon the turning on of the image transistor Q21. Consequently, the voltages V11, V12 and V1k respectively applied to the piezoelectric conversion elements Z11, Z12 and Z1k decrease to the voltage level V1.

When, the voltage transistor Q11 is turned on as dynamic-scanning and the image transistor Q21 is turned off, the discharge of the piezoelectric conversion element Z11 is suspended, and the voltage in the piezoelectric conversion element Z11 rapidly rises to the bias voltage V0. This voltage rise (V0–V1) in the piezoelectric conversion element causes an ink ejection by the ink ejection element provided with the piezoelectric conversion element Z11.

Also, the turning off of the image transistor Q21 stops the discharge of the piezoelectric conversion elements Z12 and Z1k. However, since the voltage transistors Q12 and Q1k are kept in the OFF-state during the first duration, the voltages V12 and V1k respectively applied to the piezoelectric conversion elements Z12 and Z1k do not rapidly rise but gradually rise via the resistor R4 which is applied with the bias voltage V0. Thereafter, when the voltage transistors Q12 and Q1k are turned on, the voltages V12 and V1k rise from the voltage level V3 to the bias voltage level V0. However, ink is not ejected through the ink ejection elements attached with the piezoelectric conversion elements Z12 and Z1k since the voltage rise in the piezoelectric conversion elements Z12 and Z1k is relatively moderate.

Similarly, when the voltage transistor Q12 (Q1k) is turned on simultaneously with the image transistor Q12 turning off, ink is ejected through the ink ejection element provided with the piezoelectric conversion element Z12 (Z1k), while not ejected from the ink ejection elements attached with the piezoelectric conversion elements Z11 and Z1k (Z11 and Z12).

As mentioned above, in the second modification, the resistor R4 is connected to the electrode of the piezoelectric conversion element which is not grounded. The resistor R4 is always applied with the bias voltage V0. Further, the not dynamic-scanned voltage transistors are turned on following the lapse of a specified time after the image transistor is turned on. Accordingly, the voltage applied to the piezoelectric conversion element wired to the not dynamic-scanned voltage transistor moderately rises from the voltage level V1 to the bias voltage level V0, thereby assuredly preventing an undesired ink drop.

Figure 13:
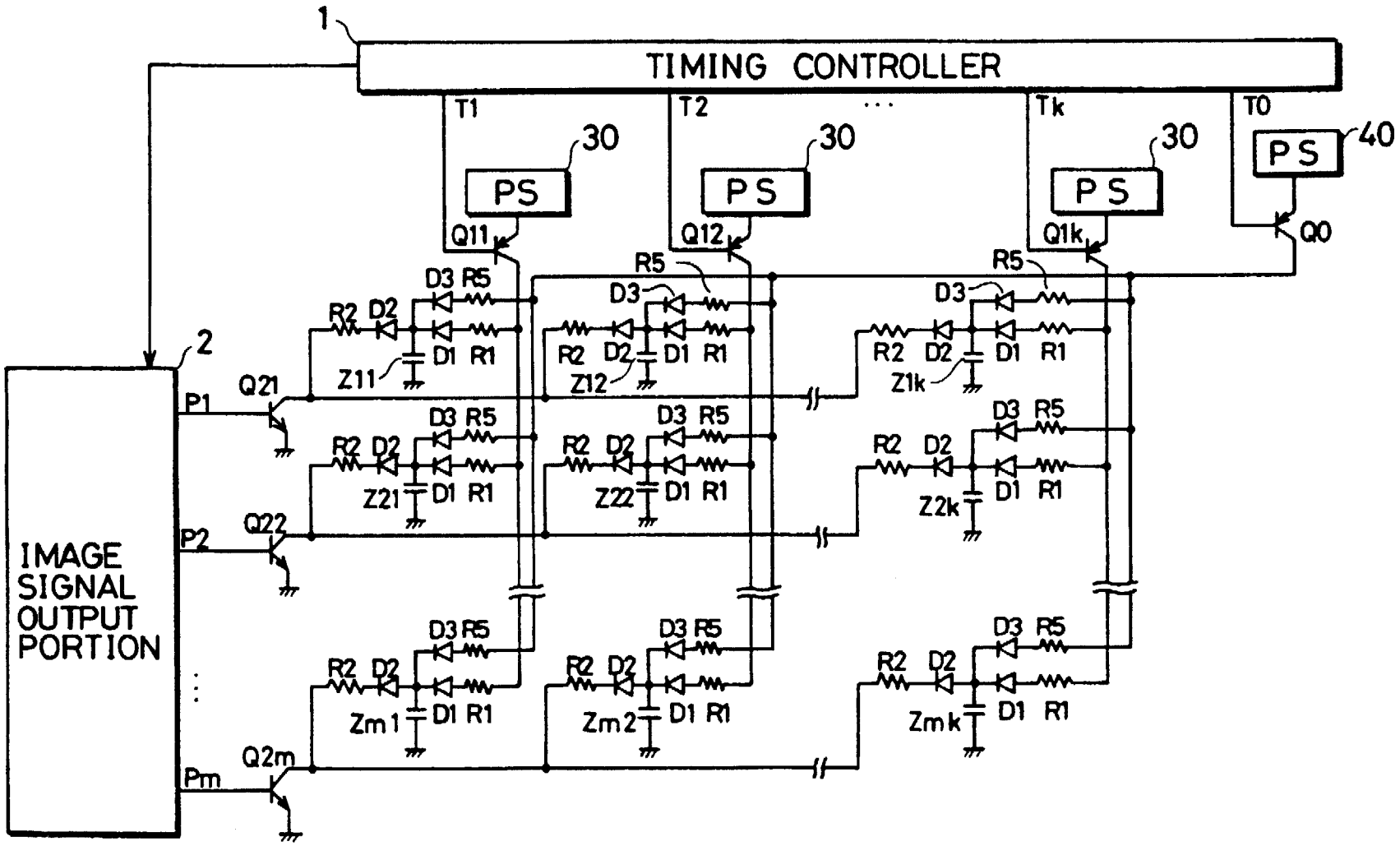
FIG. 13 is a circuit block diagram showing a construction of a third modification of the third ink ejecting device.
Figure 14:
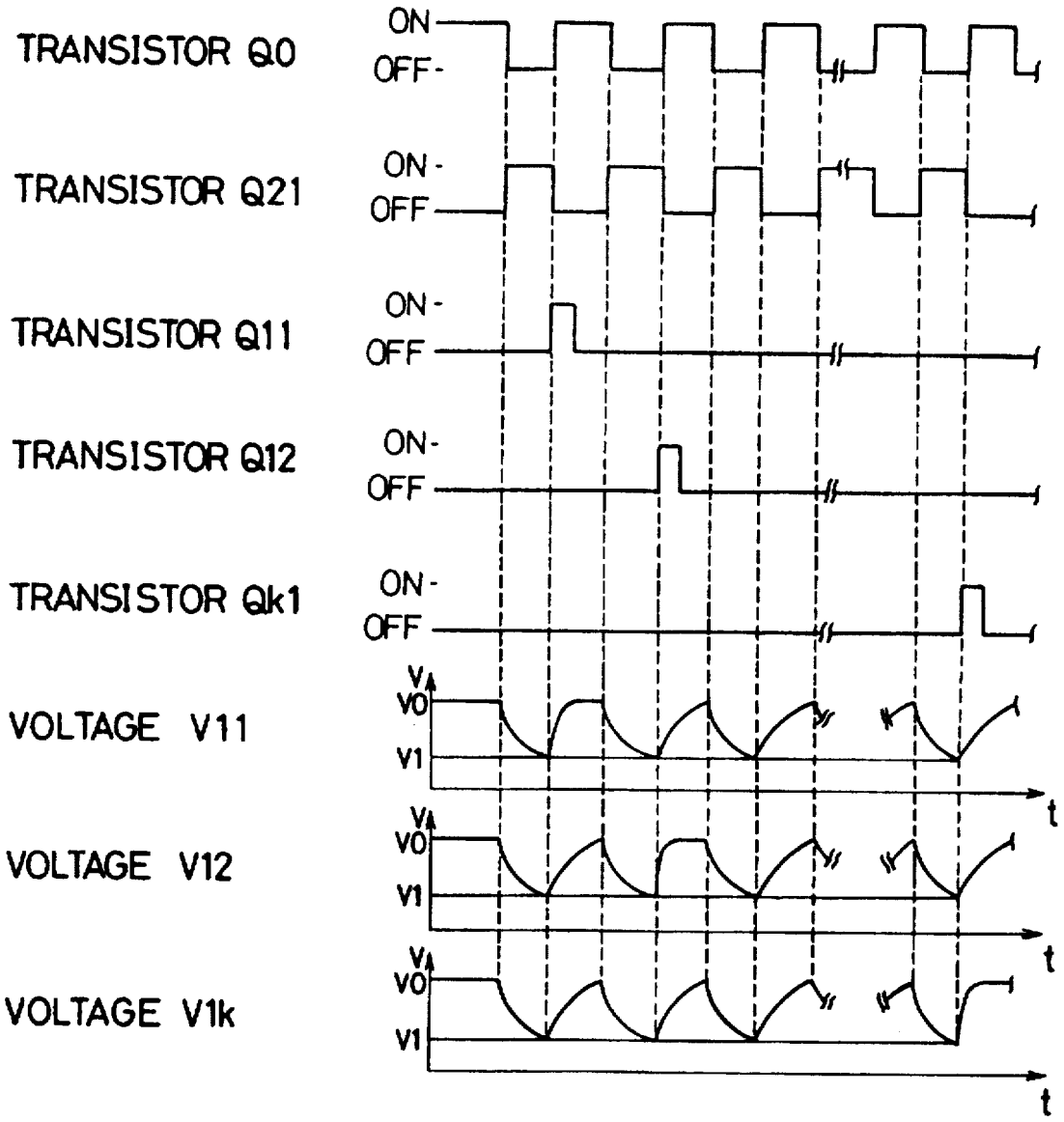
FIG. 14 is a timing chart showing a relationship between an operation of transistors and a voltage in piezoelectric conversion elements of the third modification.

FIG. 13 is a circuit block diagram showing a construction of the third modification. FIG. 14 is a timing chart showing a relationship between an operation of transistors and a voltage in piezoelectric conversion elements in the third modification.

In the third modification, there are further provided a power source 40 and a common transistor Q0. The common transistor Q0 has an emitter connected to the power source 40, a base connected to an output port T0 of a timing controller 1, and a collector connected to all the piezoelectric conversion elements via corresponding series circuits each including a resistor R5 and a diode D3. The diode D3 is connected from the resistor R5 to the corresponding piezoelectric conversion element in the forward direction.

Similar to the second modification, the resistor R5 is made to have such a resistance that the voltage in the piezoelectric conversion element gradually rises to thereby prevent an undesirable ink drop when the voltage transistor is turned off and the common transistor Q0 is turned on. Accordingly, the ink ejection can be accurately carried out by preventing any undesirable ink drops.

Next, an operation of the piezoelectric conversion elements Z11, Z12 and Z1k will be described with reference to FIG. 14. In the usual state, the image transistors and voltage transistors are in the OFF-state, and the common transistor Q0 is in the ON-state. The bias voltage V0 is applied to the piezoelectric conversion elements from the power source 40 when the image transistors are turned off. On the other hand, when the image transistors are turned on, the bias voltage V0 is suspended.

First, the common transistor Q0 is turned off, and the image transistor Q21 is turned on in response to an image signal for black image representation for the piezoelectric conversion element Z11. Consequently, the application of the bias voltage V0 to the piezoelectric conversion elements Z11, Z12 and Z1k is suspended, and an electric charge goes out from the piezoelectric conversion elements Z11, Z12 and Z1k upon the turning on of the image transistor Q21, voltages V11, V12 and V1k respectively applied to the piezoelectric conversion elements Z11, Z12 and Z1k are decreased to the voltage level V1.

Subsequently, when the common transistor Q0 and the voltage transistor Q11 are turned on, and the image transistor Q21 is turned off, the discharge of the piezoelectric conversion element Z11 is suspended. Owing to the bias voltage V0 applied from the power source 40, the voltage V11 applied to the piezoelectric conversion element Z11 rapidly rises to the voltage level V0. This rapid voltage rise (V0–V1) causes the ink ejection in the ink ejection element provided with the piezoelectric conversion element Z11.

On the other hand, when the image transistor Q21 is turned off, the discharge of the piezoelectric conversion elements Z12 and Z1k is also suspended. However, since the voltage transistors Q12 and Q1k are kept in the OFF-state, voltages V12 and V1k respectively applied to the piezoelectric conversion elements Z12 and Z1k do not rapidly rise but gradually rise to the voltage level V0 via the resistor R5 with an application of bias voltage V0 from the power source 40. The activation voltage rise of the voltages V11 and V1k is moderate, thereby eliminating the likelihood of undesirable ink drops from the ink ejection elements provided with the piezoelectric conversion elements Z12 and Z1k.

Similarly, when the voltage transistor Q12 (Q1k) is turned on, ink is ejected through the ink ejection element provided with the piezoelectric conversion element Z12 (Z1k). In the ink ejection elements provided with the piezoelectric conversion elements Z11 and Z1k (Z11 and Z12), any ink drops are assuredly prevented.

In the third modification, the power source 40 and the common transistor Q0 are provided. The common transistor Q0 is turned on and off in the reverse relationship with the turning on and off of the image transistors. The voltage transistors are turned on when receiving a drive timing signal or dynamic-scanned. Accordingly, the piezoelectric conversion elements wired to the dynamic-scanned voltage transistors are applied with the bias voltage V0 from both the power source 40 and the power source 30, and the activation voltage rapidly rises to eject ink. On the other hand, the piezoelectric conversion elements wired to the not dynamic-scanned voltage transistors are applied with the bias voltage V0 from the power source 40 only, and the activation voltage gradually rises to thereby cause no ink ejection. In this way, the ink ejection control can be accurately accomplished in a simplified construction.

Figure 15:
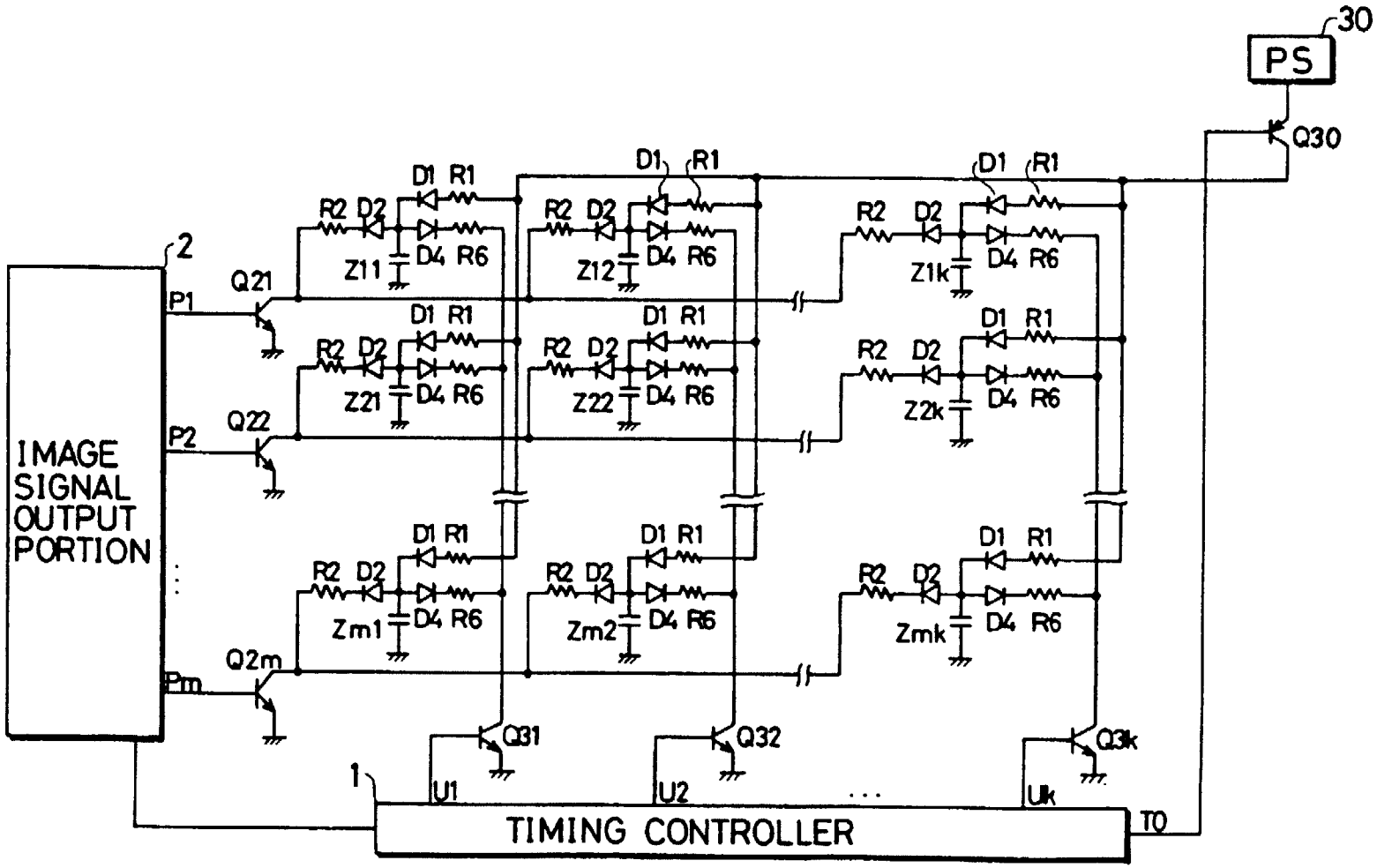
FIG. 15 is a circuit block diagram showing a construction of a fourth ink ejecting device.
Figure 16:
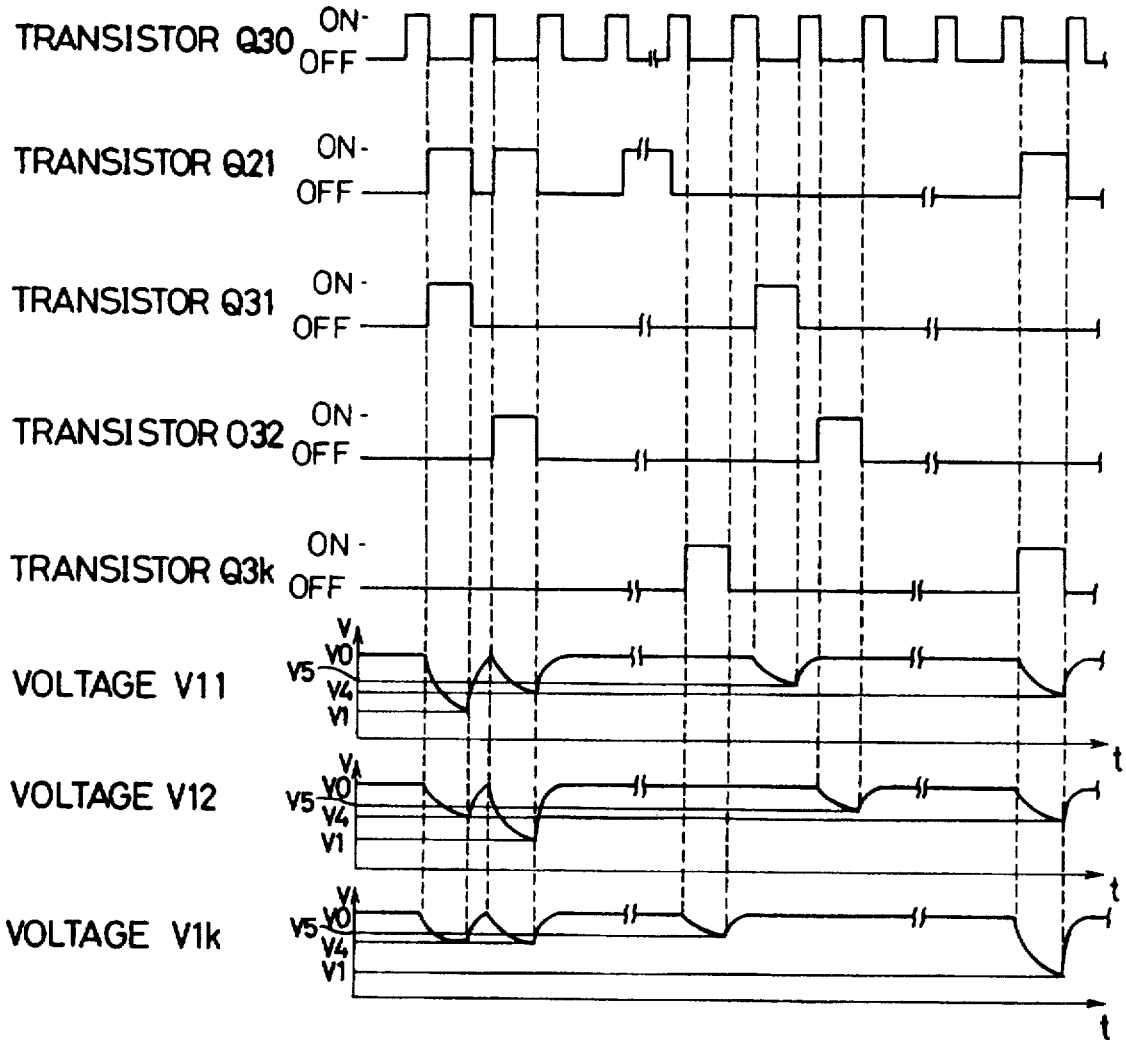
FIG. 16 is a timing chart showing a relationship between an operation of transistors and a voltage in piezoelectric conversion elements of the fourth ink ejecting device.

Next, a fourth ink ejecting device of the present invention will be described with reference to FIGS. 15 and 16. FIG. 15 is a circuit block diagram showing a construction of the fourth ink ejecting device, and FIG. 16 is a timing chart showing a relationship between an operation of transistors and a voltage of piezoelectric conversion elements.

Similar to the third embodiment, the fourth ink ejecting device comprises a timing controller 1, an image signal output portion 2, an ink ejecting portion, and a drive portion. However, the drive portion of the fourth ink ejecting device has two paths for discharging electric charges. In the fourth ink ejecting device, when electric charges are discharged by the way of two paths, the voltage applied to the piezoelectric conversion element decreases to a specified low voltage level V1.

The drive portion includes power source 30 for applying a bias voltage V0, a common transistor Q30, voltage transistors Q31 to Q3k and image transistors Q21 to Q2m. Each transistor is connected to the electrode of each of the piezoelectric conversion elements that is not grounded via a resistor and a diode.

The voltage transistor Q31 is an n-p-n type transistor. The voltage transistor Q31 has a base connected to an output port U1 of the timing controller 1, an emitter connected to the ground, and a collector connected to the piezoelectric conversion elements Z11, Z21, . . . , and Zm1 via corresponding series circuits each including a resistor R6 and a diode D4. The diode D4 is connected from the resistor R6 to the corresponding piezoelectric conversion element in the reverse direction. The voltage transistors Q32 to Q3k are also n-p-n type transistors and have an arrangement similar to the voltage transistor Q31. Specifically, the voltage transistors Q32 to Q3k each have a base connected to an output port U2 (to Uk) of the timing controller 1, an emitter connected to the ground, and a collector connected to the corresponding piezoelectric conversion element via series circuits each including a resistor R6 and a diode D4.

The common transistor Q30 is a p-n-p type transistor, and has a base connected to an output port U0 of the timing controller 1, an emitter connected to the power source 30, and a collector connected to all the piezoelectric conversion elements via series circuits each including a resistor R1 and a diode D1. The diode D1 is connected from the resistor R1 to the corresponding piezoelectric conversion element in the forward direction.

The timing controller 1 outputs a timing signal to the image signal output portion 2 and the common transistor Q30 to operate them in synchronism with each other, specifically, turn on and off the common transistor Q30 in synchronism with an image signal from the image signal output portion 2. As shown in the timing chart of FIG. 16, when the common transistor Q30 is in the OFF-state, the image transistor Q21 is in the ON-state for black image representation.

Also, the timing controller 1 outputs a high level signal to the voltage transistors Q31 to Q3k for a duration equal to the pulse width of the image signal from the output ports U1 to Uk one after another in synchronism to dynamic-scan them with the timing signal to the common transistor Q30 and image signal output portion 2. Specifically, the voltage transistors Q31 to Q3k are sequentially turned on while the common transistor Q30 is turned off.

More specifically, the common transistor Q30 is turned on to apply the bias voltage V0 to the piezoelectric conversion elements. Also, when the common transistor Q30 is turned off, image transistors Q21 to Q2m are turned on in response to an image signal for black image representation from the image signal output portion 2, an electric charge goes out from the piezoelectric conversion elements wired to the image transistors Q21 to Q2m by the way of the series circuits including the diode D2 and the resistor R2. Consequently, the voltage applied to the piezoelectric conversion elements falls from the voltage level V0 to a voltage level V4. The voltage level V4 depends on a resistance of the resistor R2.

On the other hand, when one of the voltage transistors Q31 to Q3k is turned on upon receiving a timing signal from the timing controller 1, an electric charge goes out from the piezoelectric conversion elements wired to the turned-on voltage transistor via the series circuit including the diode D4 and the resistor R6. Consequently, the voltage in the piezoelectric conversion elements falls from the voltage level V0 to a voltage level V5. The voltage level V5 depends on a resistance value of the resistor R6.

Further, the voltage applied to the piezoelectric conversion elements falls to a voltage level V1 when both the one of the voltage transistors Q31 to Q3k and the one of the image transistors Q21 to Q2m wired to the piezoelectric conversion elements are turned on.

The resistor R2 (R6) is made to have such a resistance that the deformation of the piezoelectric conversion element which is caused by the activation voltage from V4 (V5) to the bias voltage V0 causes no ink drop.

Next, an operation of the piezoelectric conversion elements Z11, Z12, Z1k and Zm1 will be described with reference to FIG. 16. The timing controller 1 controls the common transistor Q30 to turn on and off the application of the bias voltage to the respective piezoelectric conversion elements at a predetermined interval. The image transistors and the voltage transistor are usually in the OFF-state to maintain the bias voltage V0 for the piezoelectric conversion elements.

First, the common transistor Q30 is turned off, the image transistor Q21 is turned on in response to an image signal for black image representation for the piezoelectric conversion element Z11, and the voltage transistor Q31 is also turned on. Accordingly, the application of bias voltage V0 to the piezoelectric conversion element Z11 is suspended, and an electric charge goes out from the piezoelectric conversion element Z11 by way of the two paths of the resistors R2 and R6, which consequently decreases the voltage V11 to the voltage level V1.

Further, the turning-on of the image transistor Q21 causes an electric discharge in the piezoelectric conversion elements Z12 to Z1k, which results in a voltage decrease in the voltages V12 to V1k. However, since the voltage transistors Q32 and Q3k are in the OFF-state, the electric discharge is executed only through the resistor R2. Accordingly, the voltages V12 to V1k decrease to the level V4 (>V1).

Subsequently, the common transistor Q30 is turned on, and in synchronism with the turning on of the common transistor Q30, the image transistor Q21 and voltage transistor Q31 are turned off. Consequently, the electric discharge from the piezoelectric conversion element Z11 is suspended, and the piezoelectric conversion element Z11 rapidly returns to the bias voltage V0. The activation voltage change (V0–V1) causes an ink ejection by the ink ejection element provided with the piezoelectric conversion element Z11.

When the image transistor Q21 is turned off in synchronism with the turning on of the common transistor Q30, the electric discharge from the piezoelectric conversion elements Z12 to Z1k is also suspended. Consequently, the voltages V12 to V1k are also raised to the voltage level V0, and the activation voltage change (V0–V4) occurs in the piezoelectric conversion elements Z12 and Z1k. As mentioned above, however, the activation voltage change (V0–V4) is made to be so small as not to cause any ink drop. Accordingly, ink is not ejected from the ink ejection element provided with the piezoelectric conversion elements Z12 to Z1k.

Subsequently, the common transistor Q30 is turned off, the image transistor Q21 is turned on in response to an image signal for black image representation for the piezoelectric conversion element Z12, and the voltage transistor Q32 is also turned on. Consequently, the application of the bias voltage V0 to the piezoelectric conversion element Z12 is suspended, and an electric charge goes out from the piezoelectric conversion element Z12 via the paths of the resistors R2 and R6. As a result, the voltage V12 is decreased to the voltage level V1. On the other hand, since the voltage transistors Q31 to Q3k are kept in the OFF-state, an electric charge goes out from the piezoelectric conversion elements Z11 to Z1k only through the path of the resistor R2, which thus decreases the voltages V11 to V1k in the piezoelectric conversion elements Z11 to Z1k to the level V4.

Accordingly, similar to the above-mentioned operation of the voltage V11 in the piezoelectric conversion element Z11, the activation voltage change (V0–V1) in the piezoelectric conversion element Z12 causes an ink ejection in the ink ejection element provided with the piezoelectric conversion element Z11, while no ink ejection is caused in the ink ejection element provided with the piezoelectric conversion element Z11 (Z1k) because of the small activation voltage change.

Furthermore, in the case that one voltage transistor is turned on when an image signal for black image representation is not output from the image signal output portion 2, i.e., the image transistor Q21 is in the OFF-state, an electric charge goes out from the piezoelectric conversion element only through the path of the resistor R6, thereby decreasing the voltage to the voltage level V5. Thereafter, when the common transistor Q30 is turned on, the voltage is raised to the level V0 by the bias voltage V0 to the piezoelectric conversion element. As mentioned above, however, the activation voltage change (V0–V5) is made to be so small as not to cause ink drops, thus keeping ink ejection from occurring.

When the voltage transistor Q3k is turned on, the image transistor Q21 is turned on in response to an image signal for black image representation for the piezoelectric conversion element Z1k in the OFF-state of the common transistor Q30, an electric charge goes out from the piezoelectric conversion element Z1k through the two paths of the resistors R2 and R6 to thereby decrease the voltage V1k to the level V1. Thereafter, when the common transistor Q30 is turned on, the voltage V1k is raised to the bias voltage level V0. The activation voltage change (V0–V1) causes an ink ejection in the ink ejection element provided with the piezoelectric conversion element Z1k.

In the fourth ink ejecting device, two electric discharge paths are provided. More specifically, there are the electric discharge paths that is controlled by the image transistors and the electric discharge paths that is controlled by the voltage transistors. The voltage in a piezoelectric conversion element decreases to the voltage level V1 only when an electric charge goes out from the piezoelectric conversion element through both the paths and the bias voltage V0 is suspended, thereby generating the activation voltage change necessary for ink ejection when the bias voltage V0 is again applied. On the other hand, when an electric discharge occurs through one path, the voltage in the piezoelectric conversion element does not decrease to the voltage level V1, thereby not causing ink ejection or ink drop.

In this way, the ink ejection can be accurately controlled in a simplified construction. Specifically, one electrode of each piezoelectric conversion element is connected to the ground, which makes it possible to simplify the electric circuit arrangement of an ink ejecting device. The piezoelectric conversion elements of k×m are controlled by the transistors of k+m, which is a considerably smaller number. Further, the ink ejection is executed in the "after-receding ejection" way.

Figure 17:
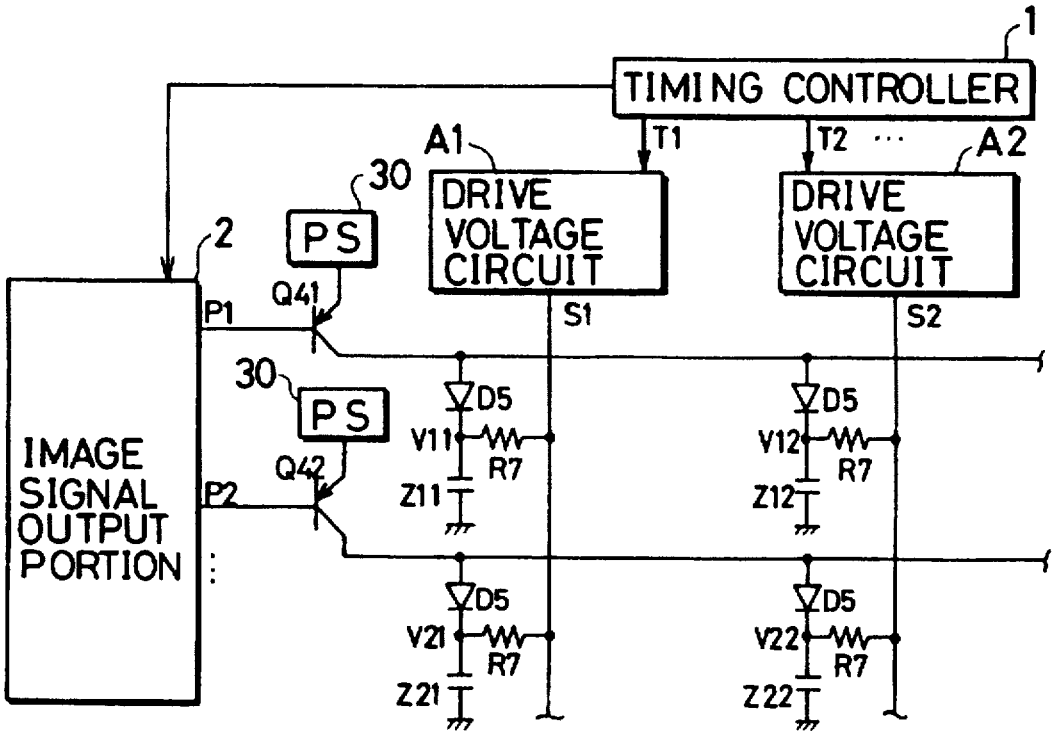
FIG. 17 is a circuit block diagram showing a construction of a fifth ink ejecting device.
Figure 18:
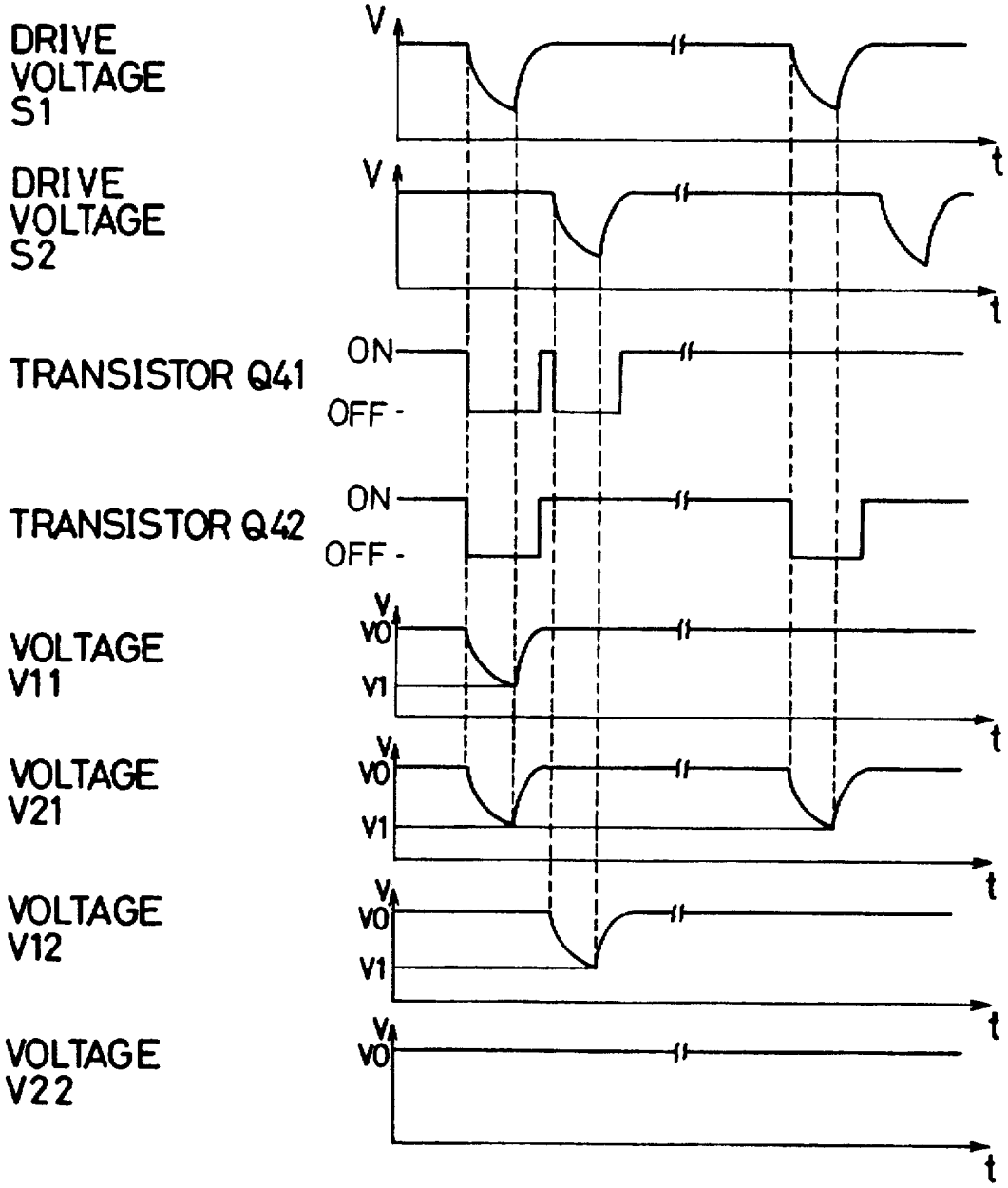
FIG. 18 is a timing chart showing a relationship between an operation of transistors and a voltage in piezoelectric conversion elements of the fifth ink ejecting device.

Next, a fifth ink ejecting device of the present invention will be described with reference to FIGS. 17 and 18. FIG. 17 is a circuit block diagram showing a construction of the fifth ink ejecting device, and FIG. 18 is a timing chart showing a relationship between an operation of transistors and a voltage of piezoelectric conversion elements of the fifth ink ejecting device.

A drive portion of this embodiment includes drive voltage circuits A1, A2, . . . , and Ak and image transistors Q41, Q42, . . . , and Q4m. The drive voltage circuit A1 is connected to piezoelectric conversion elements Z11, Z21, . . . , and Zm1 via resistors R7. Likewise, the drive voltage circuit A2 is connected to piezoelectric conversion elements Z12, Z22, . . . , and Zm2 via resistors R7. The drive voltage circuit A1 (A2) generates and outputs a drive voltage S1 (S2) including a drive voltage signal having a waveform shown in FIG. 12 in accordance with a timing signal output from a timing controller 1.

The image transistor Q41 has an emitter connected to a power source 30, a base connected to an output port P1 of an image signal output portion 2, and a collector connected to a not-grounded electrode of piezoelectric conversion elements Z11, Z12, . . . , and Z1k via diodes D5. The diode D5 is connected from the image transistor Q41 to the corresponding piezoelectric conversion element in the forward direction.

Similarly, the image transistor Q42 has an emitter connected to a power source 30, a base connected to an output port P2 of the image signal output portion 2, and a collector connected to piezoelectric conversion elements Z21, Z22, . . . , and Z2k via diodes D5.

An image signal output portion 2 outputs an image signal to the base of the image transistors Q41 to Q4m from the output ports P1 to Pm in synchronism with a timing signal output from the timing controller 1. The image transistors Q41 to Q4m are turned on and off in accordance with an image signal from the image signal output portion 2.

The timing controller 1 sequentially outputs a timing signal from output ports T1 to Tk to cause the drive voltage circuits A1, A2, . . . , and Ak to sequentially output a drive voltage signal or dynamic-scan the drive voltage circuits A1, A2, . . . , and Ak.

When an image signal is not output, the image transistors Q41, Q42, . . . , and Q4m are maintained in the ON-state. Accordingly, the bias voltage V0 of the power source 30 is usually applied to the not-grounded electrode of the piezoelectric conversion element via the diode D5, thereby keeping ink from going out.

When an image signal for black image representation is output, the image transistors Q41, Q42, . . . , and Q4m are turned off. The application of the bias voltage V0 to the piezoelectric conversion element is suspended. The voltage in the piezoelectric conversion element changes in accordance with the drive voltage from the drive voltage circuit. In the usual state, the bias voltage V0 is applied to each piezoelectric conversion element. When a drive voltage signal is output to a piezoelectric conversion element and an image signal is output to the corresponding image transistor, the voltage in the corresponding piezoelectric conversion element decreases to the voltage level V1 and then rapidly increases to the level V0 in accordance with the drive voltage signal, thereby causing an ink ejection.

Next, an operation of the piezoelectric conversion elements Z11, Z12, Z21, and Z22 will be described with reference to FIG. 18. In the usual state, since the image transistors Q41, and Q42 are kept in the ON-state, the bias voltage V0 is applied to the piezoelectric conversion elements.

First, the image transistors Q41 and Q42 are turned off in response to an image signal for black image representation from the image signal output portion 2. In synchronism with the output of the image signal, a drive voltage signal is output from the drive voltage circuit A1 in accordance with a timing signal from the timing controller 1. Consequently, the application of the bias voltage V0 is suspended, the drive voltage signal output from the drive voltage circuit A1 is applied to the piezoelectric conversion elements Z11 and Z21. The drive voltage circuit A2 outputs no drive voltage signal to the piezoelectric conversion elements Z12 and Z22.

Accordingly, the drive voltage signal having the specified waveform is applied to the piezoelectric conversion elements Z11 and Z21, respectively. The voltages V11 and V21 in the piezoelectric conversion elements Z11 and Z21 respectively change with the drive voltage signal, thereby ejecting ink from the ink ejection element provided with the piezoelectric conversion elements Z11 and Z21.

On the other hand, since the piezoelectric conversion elements Z12 and Z22 are not applied with the drive voltage signal, the voltages V12 and V22 in the piezoelectric conversion element Z12 and Z22 are at the bias voltage level V0, thereby not causing any ink ejection or ink drop by the ink ejection elements provided with the piezoelectric conversion element Z12 and Z22.

Thereafter, the image transistors Q41 and Q42 return to the ON-state. The bias voltage V0 of the power source 30 is applied to the piezoelectric conversion elements.

In the next timing, the drive voltage circuit A2 outputs a drive voltage signal. The image signal output portion 2 outputs an image signal to the transistor Q41, but not to the transistor Q42. Accordingly, the image transistor Q41 is turned off in response to the image signal while the image transistor Q42 is kept in the ON-state. In this case, no drive voltage signal is applied to the piezoelectric conversion element Z11; the bias voltage V0 of the power source 30 is applied to the piezoelectric conversion elements Z21 and Z22; and the drive voltage signal is applied to the piezoelectric conversion element Z12.

Accordingly, the voltage V12 in the piezoelectric conversion element Z12 changes with the drive voltage signal to thereby eject ink. On the other hand, the piezoelectric conversion elements Z11, Z21, and Z22 remain at the bias voltage level V0, and any ink ejection or ink drop is consequently executed in the ink ejection elements provided with the piezoelectric conversion elements Z11, Z21, and Z22.

Similar operations are repeated. In FIG. 18, in the second output of the drive voltage signal from the drive voltage circuit A1, an image signal is output to the transistor Q42, but not to the image transistor Q41. Accordingly, the image transistor Q42 is turned off while the image transistor Q41 is kept in the ON-state. Consequently, the bias voltage V0 of the power source 30 is applied to the piezoelectric conversion elements Z11 and Z12; the drive voltage signal is applied to the piezoelectric conversion element Z21; and no drive voltage signal is applied to the piezoelectric conversion element Z22. The voltage V21 in the piezoelectric conversion element Z21 changes with the drive voltage signal to thereby eject ink. On the other hand, the voltages V11, V12, and V22 in the piezoelectric conversion elements Z11, Z12, and Z22 remain at the bias voltage level V0, thereby not causing any ink ejection or ink drop.

Next, in the second output of a drive voltage signal of the drive voltage circuit A2, the image signal output portion 2 outputs no image signal. Accordingly, the image transistors Q41 and Q42 are not turned off in synchronism with the output of the drive voltage signal and are kept in the ON-state. Consequently, the bias voltage V0 of the power source 30 is continuously applied to the piezoelectric conversion elements Z11, Z12, Z21, and Z22, thereby not causing any ink ejection or ink drop.

In the fifth ink ejecting device, the drive voltage circuits A1 to Ak generate and output a drive voltage signal to the corresponding piezoelectric conversion elements. However, since the image transistors Q41 to Q4m are usually kept in the ON-state, the bias voltage V0 is applied to the piezoelectric conversion elements from the power sources 30. The transistors Q41 to Q4m are turned off when an image signal is output. The voltages in piezoelectric conversion elements Z11 to Zkm are applied with the drive voltage from the drive voltage circuits A1 to Ak. When receiving the drive voltage signal, the piezoelectric conversion element is activated by the drive voltage signal to cause an ink ejection.

Figure 19:
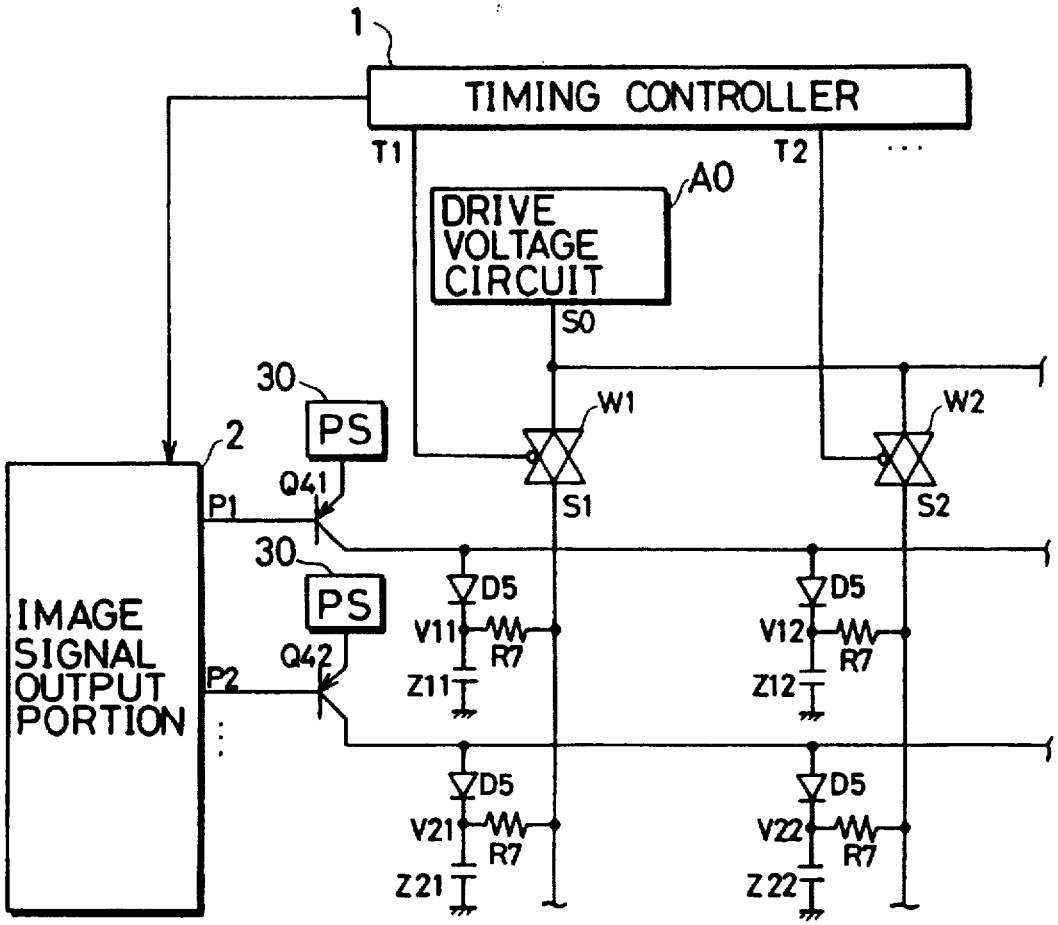
FIG. 19 is a circuit block diagram showing a construction of a modification of the fifth ink ejecting device.

Next, a modification of the fifth ink ejecting device will be described with reference to FIGS. 19 and 20. FIG. 19 is a circuit block diagram showing a construction of the modification, and FIG. 20 is a timing chart showing a relationship between an operation of switches and transistors and a voltage in piezoelectric conversion elements of the modification.

In this modification, in place of the drive voltage circuits A1 to Ak, switches W1 to Wk are provided, and a drive voltage circuit A0 is connected to the switches W1 to Wk.

Figure 20:
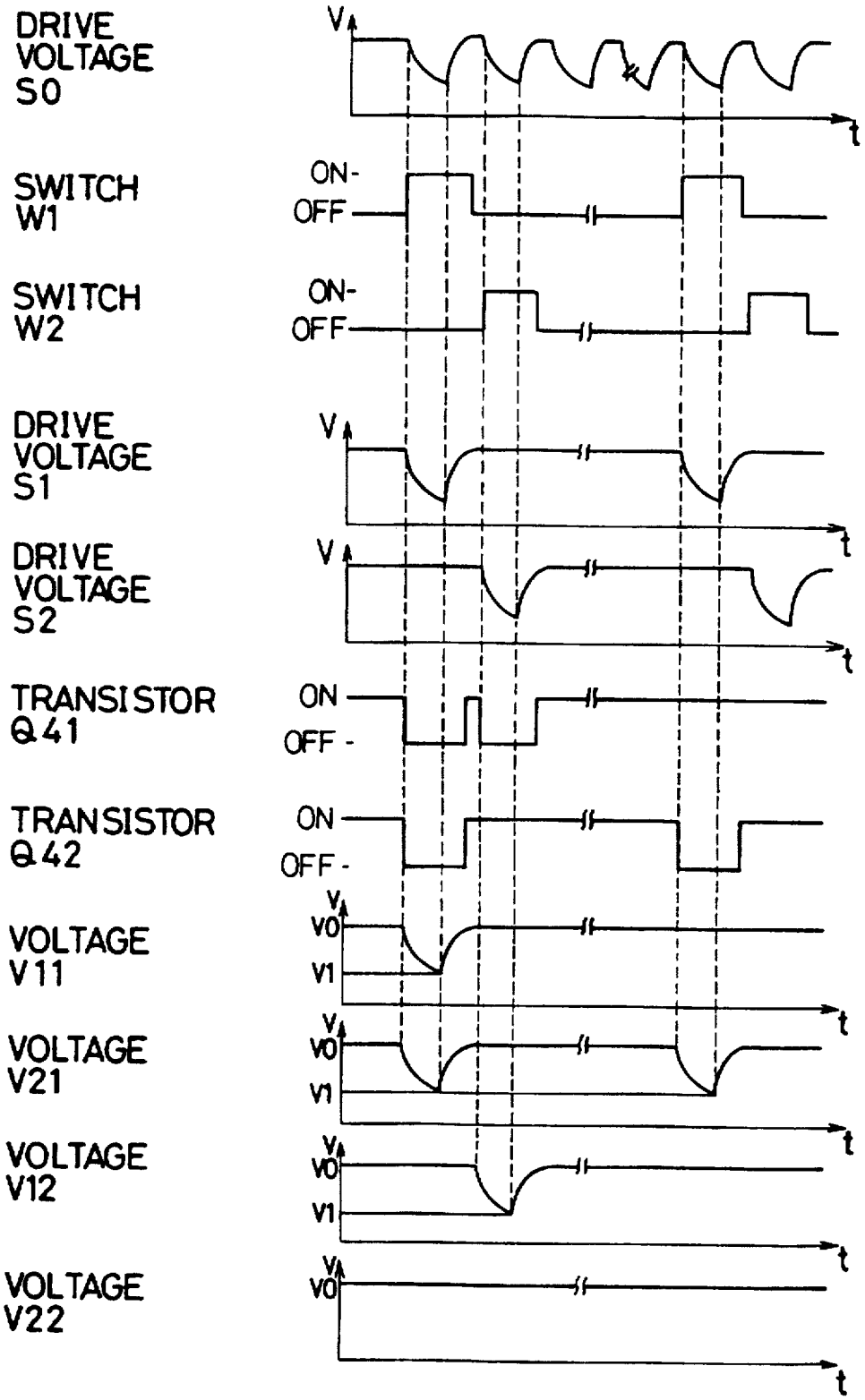
FIG. 20 is a timing chart showing a relationship between an operation of transistors and switches and a voltage in piezoelectric conversion elements of the modification of the fifth ink ejecting device.

The drive voltage circuit A0 generates a drive voltage signal having a waveform shown in a top part of FIG. 20. The drive voltage circuit A0 cyclically outputs a drive voltage signal at a predetermined interval which is controlled by a timing controller 1. The switches W1 to Wk are turned on one after another in response to a timing signal from output ports T1 to Tk of the timing controller 1.

The timing controller 1 sequentially outputs a timing signal from its output ports T1 to Tk to switches W1 to Wk and the image signal output portion 2 to execute the turning on the switches W1 to Wk and the output of an image signal in synchronism with each other.

As shown in FIG. 20, the voltages S1 to Wk output from the switches W1 to Wk are identical to those of the drive voltages S1 to Sk output from the drive voltage circuits A1 to Ak in the fifth ink ejecting device shown in FIG. 18. Accordingly, it will be seen that this modification can execute operations identical to those of the fifth embodiment.

In the foregoing embodiments, the voltage applied from the power source to the one electrode of the piezoelectric conversion element which is not connected to the ground is the positive voltage. However, the polarity may be inverted to apply the negative voltage to the one electrode which is not grounded.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An ink ejecting device for use in an ink jet printing apparatus comprising:

a number of ejecting elements, each of said ejecting elements having:

an ink chamber whose volume is changeable;

an ejection nozzle communicating with the ink chamber;

an ink supply hole communicating with the ink chamber; and a piezoelectric conversion element having a first electrode connected to ground and a second electrode;

the piezoelectric conversion elements of the number of ejecting elements being electrically arranged in a matrix having a first number of columns and a second number of rows; and a drive portion for driving said columns of said piezoelectric conversion elements to expand the ink chambers to allow ink to flow into the ink chambers and then to contract the ink chambers to eject ink from the ink chambers through the ejection nozzles, said drive portion comprising:

a drive voltage supplying portion for supplying drive voltages to said columns of said piezoelectric conversion elements;

an image signal output portion, communicable with an image signal generator, for outputting image signals to said rows of said piezoelectric conversion elements; and a controller for controlling the drive voltage supplying portion and the image signal output portion to produce an activation voltage across said piezoelectric conversion elements, the controller including:

voltage switches, individual ones of said voltage switches being provided between the drive voltage supplying portion and the second electrodes of the piezoelectric conversion elements of each of said columns for switching on and off electrical connection between the drive voltage supplying portion and the second electrodes of the piezoelectric conversion elements of each of said columns;

image signal switches, individual ones of said image signal switches being provided between the ground and the second electrodes of the piezoelectric conversion elements of each of said rows for switching on and off electrical connection between the ground and the second electrodes of the piezoelectric conversion elements of each of said rows, said image signal switches being responsive to said image signals, and a timing controlling portion for sending timing signals to successive ones of the voltage switches, for one column after another, at a specified interval to turn off one of said voltage switches at a given time to suspend the supply of drive voltage to the second electrodes of the piezoelectric conversion elements in a corresponding one of the columns for a first duration and sending a timing signal to the image signal output portion to output said image signals to the image signal switches in synchronism with the turning off of the one of said voltage switches; and whereby a combination of the turning off of the one of the voltage switches and the turning on of the image signal switches expands the ink chambers of corresponding ones of said ejecting elements, and a combination of the turning on of the one of the voltage switches and the turning off of the image signal switches contracts the ink chambers of said corresponding ones of said ejecting elements sufficiently to eject ink.

2. An ink ejecting device for use in an ink jet printing apparatus, comprising:

a number of ejecting elements, each of said ejecting elements having:

an ink chamber whose volume is changeable;

an ejection nozzle communicating with the ink chamber;

an ink supply hole communicating with the ink chamber; and a piezoelectric conversion element having a first electrode connected to ground and a second electrode;

the piezoelectric conversion elements of the number of ejecting elements being electrically arranged in a matrix having a first number of columns and a second number of rows; and a drive portion for driving said columns of said piezoelectric conversion elements to expand the ink chambers to allow ink to flow into the ink chambers and then to contract the ink chambers to eject ink from the ink chambers through the ejection nozzles, said drive portion comprising:

a drive voltage supplying portion for supplying drive voltages to said columns of said piezoelectric conversion elements, the drive voltage supplying portion including:

a common supplier for outputting a common drive voltage to the second electrodes of all the piezoelectric conversion elements; and an individual supplier for each of said columns for outputting column drive voltages to the second electrodes of the piezoelectric conversion elements in each column;

an image signal output portion, communicable with an image signal generator, for outputting image signals to said rows of said piezoelectric conversion elements; and a controller for controlling the drive voltage supplying portion and the image signal output portion to produce an activation voltage across said piezoelectric conversion elements, the controller including:

a common voltage switch provided between the common supplier and the second electrodes of all the piezoelectric conversion elements for switching on and off electrical connection between the common supplier and the second electrodes of all the piezoelectric conversion elements;

column voltage switches, individual ones of said column voltage switches being provided between the individual supplier and the second electrodes of the piezoelectric conversion elements of each column for switching on and off electrical connection between the individual supplier and the second electrodes of the piezoelectric conversion elements in each column;

image signal switches, individual ones of said image signal switches being provided between the ground and the second electrodes of the piezoelectric conversion elements of each of said rows for switching on and off electrical connection between the ground and the second electrodes of the piezoelectric conversion elements of each of said rows, said image signal switches being responsive to said image signals; and a timing controlling portion for sending:

a first timing signal to the common voltage switch at a first interval to turn off and on the common voltage switch to periodically suspend the supply of said common drive voltage to the second electrodes of all the piezoelectric conversion elements for a first duration;

a second timing signal to the image signal output portion to output said image signals to selectively turn on the image signal switches in synchronism with the turning off of the common voltage switch; and third timing signals to successively turn on individual ones of the column voltage switches, one column after another, at a second interval in synchronism with the turning on of said common voltage switch to permit supply of the column drive voltage to the second electrodes of the piezoelectric conversion elements in a respective one of said columns for a second duration, the first duration being longer than the second duration; and whereby a combination of the turning off of the common voltage switch and the selective turning on of the image signal switches expands the ink chambers of corresponding ones of said ejecting elements, and a combination of the turning on of the common voltage switch and said individual one column voltage switch and the turning off of the image signal switches contracts the ink chambers of said corresponding ones of said ejecting elements sufficiently to eject ink.

3. An ink ejecting device for use in an ink jet printing apparatus, comprising:

a number of ejecting elements, each of said ejecting elements having:

an ink chamber whose volume is changeable;

an ejection nozzle communicating with the ink chamber;

an ink supply hole communicating with the ink chamber; and a piezoelectric conversion element having a first electrode connected to ground and a second electrode;

the piezoelectric conversion elements of the number of ejecting elements being electrically arranged in a matrix having a first number of columns and a second number of rows; and a drive portion for driving said columns of said piezoelectric conversion elements to expand the ink chambers to allow ink to flow into the ink chambers and then to contract the ink chambers to eject ink from the ink chambers through the election nozzles, said drive portion comprising:

a drive voltage supplying portion for supplying drive voltage to the second electrodes of all said piezoelectric conversion elements;

an image signal output portion, communicable with an image signal generator, for outputting image signals to said rows of said piezoelectric conversion elements; and a controller for controlling the drive voltage supplying portion and the image signal output portion to produce an activation voltage across said piezoelectric conversion elements, the controller including:

a voltage switch provided between the drive voltage supplying portion and the second electrodes of all the piezoelectric conversion elements for switching on and off electrical connection between the drive voltage supplying portion and the second electrodes of all the piezoelectric conversion elements;

image signal switches, individual ones of said image signal switches being provided between the ground and the second electrodes of the piezoelectric conversion elements of each of said rows for switching on and off electrical connection between the ground and the second electrodes of the piezoelectric conversion elements of each of said rows, the image signal switches being responsive to said image signals;

column switches, individual ones of said column switches being provided between the ground and the second electrodes of the piezoelectric conversion elements of each of said columns for switching on and off electrical connection between the ground and the second electrodes of the piezoelectric conversion elements of a corresponding one of said columns; and a timing controlling portion for sending:

a first timing signal to the voltage switch at a specified interval to turn off and on the voltage switch to periodically suspend the supply of said drive voltage to all the piezoelectric conversion elements for a specified duration;

a second timing signal to the image signal output portion to output said image signals to the image signal switches to selective turn on said image signal switches in synchronism with the turning off of the voltage switch; and third timing signals to the column switches to successively turn on individual ones of said column switches, one column after another, in synchronism with the turning off of the voltage switch, to permit an electric discharge from the piezoelectric conversion elements, in a corresponding one of said columns, to the ground; and whereby a combination of the turning off of the voltage switch and the turning on of the image signal switches and one of said column switches expands the ink chambers of corresponding ones of said ejecting elements, and a combination of the turning on of the voltage switch and the turning off of the image signal switches and the one of the column switches contracts the ink chamber sufficiently to eject ink.

4. An ink ejecting device for use in an ink jet printing apparatus, comprising:

a number of ejecting elements, each of said ejecting elements having:

an ink chamber whose volume is changeable;

an ejection nozzle communicating with the ink chamber;

an ink supply hole communicating with the ink chamber; and a piezoelectric conversion element having a first electrode connected to ground and a second electrode;

the piezoelectric conversion elements of the number of ejecting elements being electrically arranged in a matrix having a first number of columns and a second number of rows; and a drive portion for driving said columns of said piezoelectric conversion elements to expand the ink chambers to allow ink to flow into the ink chambers and then to contract the ink chambers to eject ink from the ink chambers through the ejection nozzles, said drive portion comprising:

a drive voltage supplying portion for supplying drive voltages to said columns of said piezoelectric conversion elements, the drive voltage supplying portion including:

a bias voltage supplier for supplying a bias voltage to the second electrodes of the piezoelectric conversion elements; and a drive voltage signal supplier for outputting a drive voltage signal to the second electrodes of the piezoelectric conversion elements in each column, the drive voltage signal having an expansion duration for expanding the ink chambers and a contraction duration for contracting the ink chambers;

an image signal output portion, communicable with an image signal generator, for outputting image signals to said rows of said piezoelectric conversion elements;

a controller for controlling the drive voltage supplying portion and the image signal output portion to produce an activation voltage across said piezoelectric conversion elements, the controller including:

image signal switches, individual ones of said image signal switches being provided between the bias voltage supplier and the second electrodes of the piezoelectric conversion elements of each of said rows for switching on and off electrical connection between the bias voltage supplier and the second electrodes of the piezoelectric conversion elements of each of said rows, the image signal switches being responsive to said image signals;

a timing controlling portion for sending:

a first timing signal to the drive voltage signal supplier at a specified interval to output said drive voltage signal to the piezoelectric conversion elements in one column; and a second timing signal to the image signal output portion to output said image signals to the image signal switches to turn off select ones of said image signal switches, selected by said image signals, to interrupt the supply of bias voltage to the piezoelectric conversion elements in each row in synchronism with the output of the drive voltage signal; and whereby a combination of the output of the drive voltage signal and the turning off of the image signal switches expands the ink chambers of corresponding ones of said ejecting elements and contracts the ink chambers of said corresponding ones of said ejecting elements, in accordance with the drive voltage signal, sufficiently to eject ink.

5. An ink ejecting device for use in an ink jet printing apparatus, comprising:

a number of ejecting elements arranged in a matrix having k columns and m rows where k and m are positive integers, each ejecting element having:

an ink chamber with a volume that is changeable;

an ejection nozzle communicating with the ink chamber;

an ink supply hole communicating with the ink chamber; and a piezoelectric element; and a drive portion for driving said piezoelectric conversion elements of each of said columns by expanding the ink chambers to allow ink to flow into the ink chambers and then contracting the ink chambers to eject ink from the ink chambers through the ejection nozzles, said drive portion including:

a drive voltage supplying portion for supplying a drive voltage signal to said piezoelectric conversion elements such that each of the piezoelectric conversion elements is charged to a specified voltage when in an inactive state; and a controller for controlling a supply of said drive voltage signal to said piezoelectric conversion elements in a specified one of said columns such that the supply of the specified voltage to the piezoelectric conversion elements is first suspended in the specified one of said columns to expand said ink chambers and, after the supply of the specified voltage is suspended, the specified voltage is supplied again to the piezoelectric conversion elements to contract said ink chambers to enable ejection of ink from the ink chambers through the ejection nozzles.

6. An ink ejecting device for use in an ink jet printing apparatus, comprising:

a number of ejecting elements arranged in a matrix having k columns and m rows where k and m are positive integers, each ejecting element having:

an ink chamber with a volume that is changeable;

an ejection nozzle communicating with the ink chamber;

an ink supply hole communicating with the ink chamber; and a piezoelectric element for changing said volume of said ink chamber;

a drive portion for driving said piezoelectric conversion elements of each of said columns by expanding the ink chambers to allow ink to flow into the ink chambers and contracting the ink chambers to eject ink from the ink chambers through the ejection nozzles, the drive portion including:

a drive voltage supplying portion for supplying a drive voltage signal to said piezoelectric conversion elements such that each of said piezoelectric conversion elements are charged to have a voltage equal a specified voltage prior to activation; and a controller for controlling the drive voltage supplying portion, said controller having a timing controlling portion for sending a timing signal to said piezoelectric conversion elements of each of said columns, successively one column after another and at a specified interval, such that the voltage of the piezoelectric conversion elements of said one column of said columns temporarily falls and then rises to first expand and then to contract corresponding ones of said ink chambers to eject ink therefrom.

7. An ink ejecting device for use in an ink jet printing apparatus comprising:

a number of ejecting elements, each of said ejecting elements having:

an ink chamber with a volume that is changeable;

an ejection nozzle communicating with the ink chamber;

an ink supply hole communicating with the ink chamber; and a piezoelectric conversion element for changing said volume of said ink chamber; and a drive circuit for driving said piezoelectric conversion elements to expand the ink chambers to allow ink to flow into the ink chambers and then to contract the ink chambers to eject ink from the ink chambers through the ejection nozzles, said drive circuit comprising:

a drive voltage supplying circuit for supplying a drive voltage to said piezoelectric conversion elements;

an image signal output circuit, communicable with an image signal generator, for outputting image signals; and a controller for controlling application of said image signals and said drive voltage to said piezoelectric conversion elements to produce an activation voltage change across said piezoelectric conversion elements, the controller including:

drive voltage switches connecting said drive voltage to said piezoelectric conversion elements, via a charge path, for switching on and off application of said drive voltage, said drive voltage switches being in a closed state making electrical connection between the drive voltage supplying circuit and the piezoelectric conversion elements prior to production of said activation voltage change;

image signal switches for closing a discharge paths for discharging said piezoelectric conversion elements in response to said image signals directing ejection of ink, said image signal switches being in an open state prior to production of said activation voltage change; and a timing controlling circuit sending:

first timing signals to at least one of the drive voltage switches to disconnect application of said drive voltage to corresponding ones of said piezoelectric conversion elements during a specified interval; and a second timing signal to the image signal output circuit to output said image signals to the image signal switches of said corresponding ones of said piezoelectric conversion elements, during said specified interval, to close selected ones of said image signal switches to discharge selected ones of said corresponding ones of said piezoelectric conversion elements and expand associated ones of said ink chambers such that when said specified interval passes said selected ones of said corresponding ones of said piezoelectric conversion elements that have discharged recharge, producing said activation voltage change, to contract said associated ones of said ink chambers to eject ink therefrom.

8. An ink ejecting device for use in an ink jet printing apparatus comprising:

a number of ejecting elements, each of said ejecting elements having:

an ink chamber with a volume that is changeable;

an ejection nozzle communicating with the ink chamber;

an ink supply hole communicating with the ink chamber; and a piezoelectric conversion element for changing said volume of said ink chamber;

the piezoelectric conversion elements of the number of ejecting elements being electrically arranged in a matrix having a first number of columns and a second number of rows;

a drive voltage circuit applying a drive voltage to said columns of said piezoelectric conversion elements via charge paths to maintain said piezoelectric conversion elements in a charged state prior to activation and successively interrupting application of said drive voltage to said columns of said piezoelectric conversion elements, one of said columns at a time, during interrupt intervals; and an imaging driver circuit discharging selected ones of said rows of said piezoelectric conversion elements via discharge paths during said interrupt intervals such that a combination of said imaging driver circuit discharging said selected ones of said rows of said piezoelectric conversion elements and said drive voltage circuit interrupting said application of said drive voltage to said one of said columns of said piezoelectric conversion elements sufficiently discharges common ones of said piezoelectric conversion elements, common to both said selected ones of said row and said one of said columns, to expand corresponding ones of said ink chambers so that after passage of said interrupt intervals said drive voltage circuit recharges said common ones of said piezoelectric conversion elements sufficiently to contract said corresponding ones of said ink chambers to eject ink therefrom.

9. The ink ejecting device of claim 8 wherein said drive voltage circuit includes:

a power supply outputting said drive voltage;

column switch devices, each one of said column switch devices connecting said power supply to said charge paths of a respective one of said columns of said piezoelectric conversion elements; and a control circuit controlling said column switch devices to effect said successive interrupting application of said drive voltage.

10. The ink ejecting device of claim 8 wherein said imaging driver circuit includes:

row switch devices, each one of said row switch devices connecting said discharge paths of a respective one of said rows of said piezoelectric conversion elements to a discharging potential; and a control circuit controlling said row switch devices to effect said discharging of said selected ones of said rows of said piezoelectric conversion elements.

11. The ink ejecting device of claim 8 wherein said charge paths and said discharge paths have respective resistances such that ones of said piezoelectric conversion elements other than said common ones are not sufficiently discharged to permit ejection of ink therefrom.

12. An ink ejecting device for use in an ink jet printing apparatus, comprising:

a number of ejecting elements, each of said ejecting elements having:

an ink chamber with a volume that is changeable;

an ejection nozzle communicating with the ink chamber;

an ink supply hole communicating with the ink chamber; and a piezoelectric conversion element for changing said volume of said ink chamber;

the piezoelectric conversion elements of the number of ejecting elements being electrically arranged in a matrix having a first number of columns and a second number of rows;

a common drive voltage circuit periodically applying and interrupting application of a drive voltage to all said piezoelectric conversion elements via charge paths during respective application intervals and interruption intervals, said common drive voltage circuit charging all said piezoelectric conversion elements during said application intervals to charge said piezoelectric conversion elements prior to activation;

a column discharge circuit sequentially discharging said columns of said piezoelectric conversion elements via first discharge paths, one of said columns at a time, during corresponding ones of said interruption intervals; and an imaging driver circuit discharging selected ones of said rows of said piezoelectric conversion elements via second discharge paths during said interruption intervals such that a combination of said imaging driver circuit and said column discharge circuit both discharging common ones of said piezoelectric conversion elements, common to both said selected ones of said rows and said one of said columns, sufficiently discharges said common ones of said piezoelectric conversion elements to expand corresponding ones of said ink chambers so that said common ones of said piezoelectric conversion elements recharge sufficiently during a following one of said application intervals to contract said corresponding ones of said ink chambers to eject ink therefrom.

13. The ink ejecting device of claim 12 wherein said common drive voltage circuit includes:

a power supply outputting said drive voltage;

at least one switch device connecting said power supply to said charge paths of all of said piezoelectric conversion elements; and a control circuit controlling said switch device to effect said interrupting application of said drive voltage.

14. The ink ejecting device of claim 12 wherein said column discharge circuit includes:

column switch devices, each one of said column switch devices connecting a discharging potential to said first discharge paths of a respective one of said columns of said piezoelectric conversion elements; and a control circuit controlling said column switch devices to effect said sequential discharging of said columns of said piezoelectric conversion elements via first discharge paths.

15. The ink ejecting device of claim 12 wherein said imaging driver circuit includes:

row switch devices, each one of said row switch devices connecting said second discharge paths of a respective one of said rows of said piezoelectric conversion elements to a discharging potential; and a control circuit controlling said row switch devices to effect said discharging of said selected ones of said rows of said piezoelectric conversion elements.

16. The ink ejecting device of claim 12 wherein said charge paths and said first and second discharge paths have respective resistances such that ones of said piezoelectric conversion elements other than said common ones are not sufficiently discharged to permit ejection of ink therefrom.

17. An ink ejecting device for use in an ink jet printing apparatus, comprising:

a number of ejecting elements, each of said ejecting elements having:

an ink chamber with a volume that is changeable;

an ejection nozzle communicating with the ink chamber;

an ink supply hole communicating with the ink chamber; and a piezoelectric conversion element for changing said volume of said ink chamber;

the piezoelectric conversion elements of the number of ejecting elements being electrically arranged in a matrix having a first number of columns and a second number of rows;

a drive voltage circuit maintaining said columns of said piezoelectric conversion elements in a charged state at a specified voltage via drive paths prior to activation of said piezoelectric conversion elements and successively driving said columns of said piezoelectric conversion elements, one of said columns at a time, with a drive signal for activation that first discharges said piezoelectric conversion elements via said drive paths to expand corresponding ones of said ink chambers and then charges said piezoelectric conversions elements via said drive paths back to said specified voltage to contract said corresponding ones of said ink chambers to eject ink therefrom; and an imaging driver circuit applying a charging potential to said rows of said piezoelectric conversion elements via charge paths to charge said piezoelectric conversion elements to overcome effects of said drive signal of said drive voltage, and interrupting application of said charging potential to said charge paths of selected ones of said rows to permit said discharging and said charging of common ones of said piezoelectric conversion elements, common to both said selected ones of said rows and said one of said columns, by said drive signal of said drive voltage circuit and ejection of ink.

18. The ink ejecting device of claim 17 wherein said imaging driver circuit includes:

row switch devices, each one of said row switch devices connecting said charge paths of a respective one of said rows of said piezoelectric conversion elements to a charging potential; and a control circuit controlling said row switch devices to effect said interrupting application of said charging potential of said selected ones of said rows of said piezoelectric conversion elements.

19. The ink ejecting device of claim 17 wherein said charge paths and said drive paths have respective resistances such that ones of said piezoelectric conversion elements other than said common ones are not sufficiently discharged to permit ejection of ink therefrom.

* * * * *